US009527293B2

(12) United States Patent
Tamura et al.

(10) Patent No.: US 9,527,293 B2
(45) Date of Patent: Dec. 27, 2016

(54) RECORDING APPARATUS

(71) Applicant: SEIKO EPSON CORPORATION, Tokyo (JP)

(72) Inventors: Yosaku Tamura, Matsumoto (JP); Atsushi Nakazawa, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/074,032

(22) Filed: Mar. 18, 2016

(65) Prior Publication Data

US 2016/0279951 A1 Sep. 29, 2016

(30) Foreign Application Priority Data

Mar. 27, 2015 (JP) ..... 2015-067234

(51) Int. Cl.
*B41J 2/165* (2006.01)

(52) U.S. Cl.
CPC ..... *B41J 2/16535* (2013.01); *B41J 2/1652* (2013.01); *B41J 2/16505* (2013.01); *B41J 2/16547* (2013.01); *B41J 2/16508* (2013.01); *B41J 2002/16502* (2013.01)

(58) Field of Classification Search
None
See application file for complete search history.

(56) References Cited

U.S. PATENT DOCUMENTS

2008/0129776 A1* 6/2008 Taira ..... B41J 2/16526 347/33
2008/0278537 A1* 11/2008 Watanabe ..... B41J 2/16538 347/32
2013/0182036 A1* 7/2013 Park ..... B41J 2/16508 347/30

FOREIGN PATENT DOCUMENTS

JP 2009-119652 A 6/2009
JP 2013-136221 A 7/2013

* cited by examiner

*Primary Examiner* — Lisa M Solomon
(74) *Attorney, Agent, or Firm* — Workman Nydegger

(57) ABSTRACT

A recording apparatus includes a recording head with liquid ejecting nozzles which eject a liquid onto a recording medium provided in a nozzle surface, a wiper which wipes the nozzle surface, and a cover which is positioned between the recording medium and a rim of the nozzle surface and covers the rim of the nozzle surface.

13 Claims, 16 Drawing Sheets

RECORDING APPARATUS

BACKGROUND

1. Technical Field

The present invention relates to a recording apparatus which is provided with a recording head with liquid ejecting nozzles which eject a liquid onto a recording medium provided in a nozzle surface, and a wiper which wipes the nozzle surface.

2. Related Art

An ink jet printer, which is an example of a recording apparatus, is provided with a recording head with nozzles which eject an ink, which is an example of the liquid, onto recording paper, which is an example of the recording medium, provided in a nozzle surface. Since unnecessary ink becomes adhered to the nozzle surface, the ink jet printer is provided with a wiper which carries out the wiping of the nozzle surface.

When the wiper wipes the nozzle surface, the ink which is adhered to the nozzle surface may accumulate at the rim of the nozzle surface (hereinafter, referred to as an "ink accumulation", as appropriate). Meanwhile, there is a concern that there is curvature in the recording paper, the recording paper makes contact with the ink accumulation due to the curvature, and the recording paper becomes dirtied.

In order to avoid such a problem, an image forming apparatus described in JP-A-2009-119652 is provided with a protruding section which protrudes downward from the nozzle surface, and the recording medium is prevented from making contact with the ink accumulation due to the recording medium abutting the protruding section even if the recording medium bends upward due to curvature, jumping, or cockling.

However, in the image forming apparatus described in JP-A-2009-119652, in particular, when curling at the leading end or the trailing end of the recording paper is conspicuous, there is a concern that the leading end or the trailing end will exceed the protruding section and make contact with the ink accumulation.

SUMMARY

An advantage of some aspects of the invention is that recording paper is more reliably prevented from making contact with an ink accumulation which is present on a rim of a nozzle surface.

According to an aspect of the invention, a recording apparatus includes a recording head with liquid ejecting nozzles which eject a liquid onto a recording medium provided in a nozzle surface, a wiper which wipes the nozzle surface, and a cover which is positioned between the recording medium and a rim of the nozzle surface and covers the rim of the nozzle surface.

According to this aspect, since the cover which is positioned between the recording medium and the rim of the nozzle surface and covers the rim of the nozzle surface is provided, it is possible to reliably prevent the recording medium from making contact with a liquid accumulation which is present on the rim of the nozzle surface using the cover.

The recording apparatus may further include a receiving section which receives the liquid which is ejected from the recording head, in which the receiving section may be configured to be capable of moving between a receiving position at which the receiving section faces the recording head and a withdrawn position at which the receiving section is withdrawn from the receiving position, in which the cover may be provided to be capable of switching between a first state of covering the rim of the nozzle surface and a second state of being separated from the rim, in which the receiving position of the receiving section may be positioned on a movement track of the cover between the first state and the second state, and in which the cover may assume the second state during operation of the receiving section.

According to this aspect, since the receiving position of the receiving section is positioned on the movement track of the cover between the first state and the second state, at least a portion of the cover is in a position which interferes with the receiving section which is in the receiving position during the state switching. In other words, the cover is provided to extend sufficiently, it is possible to secure the length of the cover, and, by more reliably covering the rim of the nozzle surface, it is possible to more reliably prevent the recording medium from making contact with the liquid accumulation. Since the cover assumes the second state during the operation of the receiving section, it is possible to smoothly perform the state switching of the receiving section without obstructing the operation of the receiving section.

Note that, in the present specification, "during the operation of the receiving section" means a time span in which the receiving section moves from the withdrawn position to the receiving position, assumes the state of facing the recording head, and subsequently returns to the withdrawn position from the receiving position.

In the recording apparatus, the receiving section may be a cap section capable of sealing the recording head, and the receiving position may be a sealing position at which the nozzle surface is sealed.

In the recording apparatus, the receiving section may be a flushing receiving section which receives the liquid which is ejected during flushing which is carried out before the recording head performs the wiping, and the receiving position may be a position at which the droplets which are ejected during the flushing do not splash on a periphery of the receiving section.

According to this aspect, since the receiving position is set to a position at which the droplets which are ejected during the flushing do not splash on the periphery of the receiving section, it is possible to suppress the dirtying of the inside of the apparatus, in particular, the transport path of the recording medium, by the droplets during the flushing, and it is possible to suppress a reduction in the recording quality of the recording medium.

In the recording apparatus, the receiving position of the receiving section may include a first receiving position and a second receiving position, the first receiving position may be a sealing position at which the nozzle surface is sealed, and the second receiving position may be a position at which the droplets which are ejected during the flushing do not splash on a periphery of the receiving section.

According to this aspect, since the second receiving position is set to a position at which the droplets which are ejected during the flushing do not splash on the periphery of the receiving section, it is possible to suppress the dirtying of the inside of the apparatus, in particular, the transport path of the recording medium, by the droplets during the flushing, and it is possible to suppress a reduction in the recording quality of the recording medium.

In the recording apparatus, the recording head may be provided to be capable of proceeding and withdrawing in relation to the receiving section which is in the receiving position, and, according to a proceeding or withdrawing operation of the recording head, the cover may switch from the first state to the second state when the recording head proceeds in relation to the receiving section, and may switch from the second state to the first state when the recording head separates from the receiving section.

According to this aspect, since the cover is configured to perform the state switching according to the proceeding and withdrawing operations of the recording head, it is possible to configure the unit that performs the state switching of the cover at low cost.

The recording apparatus may further include a support unit capable of supporting the recording medium, in which the recording head may be capable of changing a height in relation to the support unit according to a type of the recording medium and performing recording, and in which the cover may move from the first state to the second state when the recording head is lowered to a position lower than a lowest position when performing the recording.

The recording apparatus may further include a support unit capable of switching between a facing state in which the support unit faces the recording head and is capable of supporting the recording medium, and a non-facing state in which the support unit does not face the recording head, in which the support unit which is in the facing state may be positioned on a movement track of the cover between the first state and the second state, and the cover may move to the second state when the support unit is positioned in the non-facing state.

According to this aspect, since the support unit which is in the facing state is positioned on the movement track of the cover between the first state and the second state, the cover is in a position which interferes with the support unit which is in the facing state during the state switching. In other words, the cover is provided to extend sufficiently, it is possible to secure the length of the cover, and, by more reliably covering the rim of the nozzle surface, it is possible to more reliably prevent the recording medium from making contact with the liquid accumulation.

The recording apparatus may further include a support unit which faces the recording head and is capable of supporting the recording medium, a transport unit which transports the recording medium to the recording head, an output unit which outputs the recording medium which is recorded on by the recording head, and at least one detection unit which detects passage of the recording medium over the transport unit and the output unit, in which, in a case in which the detection unit determines that the recording medium is jammed, the cover may maintain the first state.

According to this aspect, in a case in which the detection unit determines that the recording medium is jammed, since the cover maintains the first state, it is possible to prevent the recording medium from making contact with the rim of the nozzle surface when removing the recording medium, and it is possible to more reliably prevent the recording medium from making contact with the liquid accumulation.

In the recording head, in a case in which the detection unit determines that the recording medium is jammed, the recording head may be moved in a direction in which the recording head separates from the support unit.

According to this aspect, in a case in which the detection unit determines that the recording medium is jammed, since the recording head is moved in a direction separating from the support unit, it is possible to suppress the recording medium in the state in which the liquid is ejected thereon making contact with the nozzle surface when removing the recording medium, and it is possible to suppress the dirtying of the nozzle surface.

In the recording apparatus, the recording head may be provided to extend in a width direction which is a direction intersecting a transport direction of the recording medium, the wiper may accumulate the liquid at an edge portion of an upstream side or a downstream side of the rim of the nozzle surface in the transport direction by moving in the width direction to wipe the nozzle surface in a state of having an inclination angle in relation to the transport direction of the recording medium, and the cover may cover the edge portion of the upstream side or the downstream side of the rim of the nozzle surface in the transport direction at which the liquid is accumulated.

According to this aspect, the liquid is accumulated in a fixed position (of the rim of the nozzle surface, an edge portion of the upstream side or the downstream side in the transport direction), that is, a liquid accumulation is formed in the fixed position, and since the position is covered by the cover, it is possible to more efficiently and effectively prevent the recording medium from making contact with the liquid accumulation.

In the recording apparatus, the wiper may accumulate the liquid at the upstream side of the rim of the nozzle surface in the transport direction, and the cover may cover the edge portion of the upstream side of the nozzle surface in the transport direction.

According to this aspect, since the wiper accumulates the liquid at the upstream side of the rim of the nozzle surface in the transport direction, and the cover covers the edge portion of the upstream side of the nozzle surface in the transport direction, it is possible to avoid the leading end of the recording medium which proceeds from the upstream side to the downstream side in the transport direction catching on the cover.

In the recording apparatus, the cover may also serve as a guide member which guides the recording medium to the downstream side.

According to this aspect, since the cover also serves as a guide member which guides the recording medium to the downstream side, it is possible to obtain cost reductions in the apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of embodiments of the invention based on the drawings. Note that, the same constituent elements in each of the examples will be given the same symbols, will only be explained in the first example, and explanation of these constituent elements will be omitted from the following examples.

Figure 1:
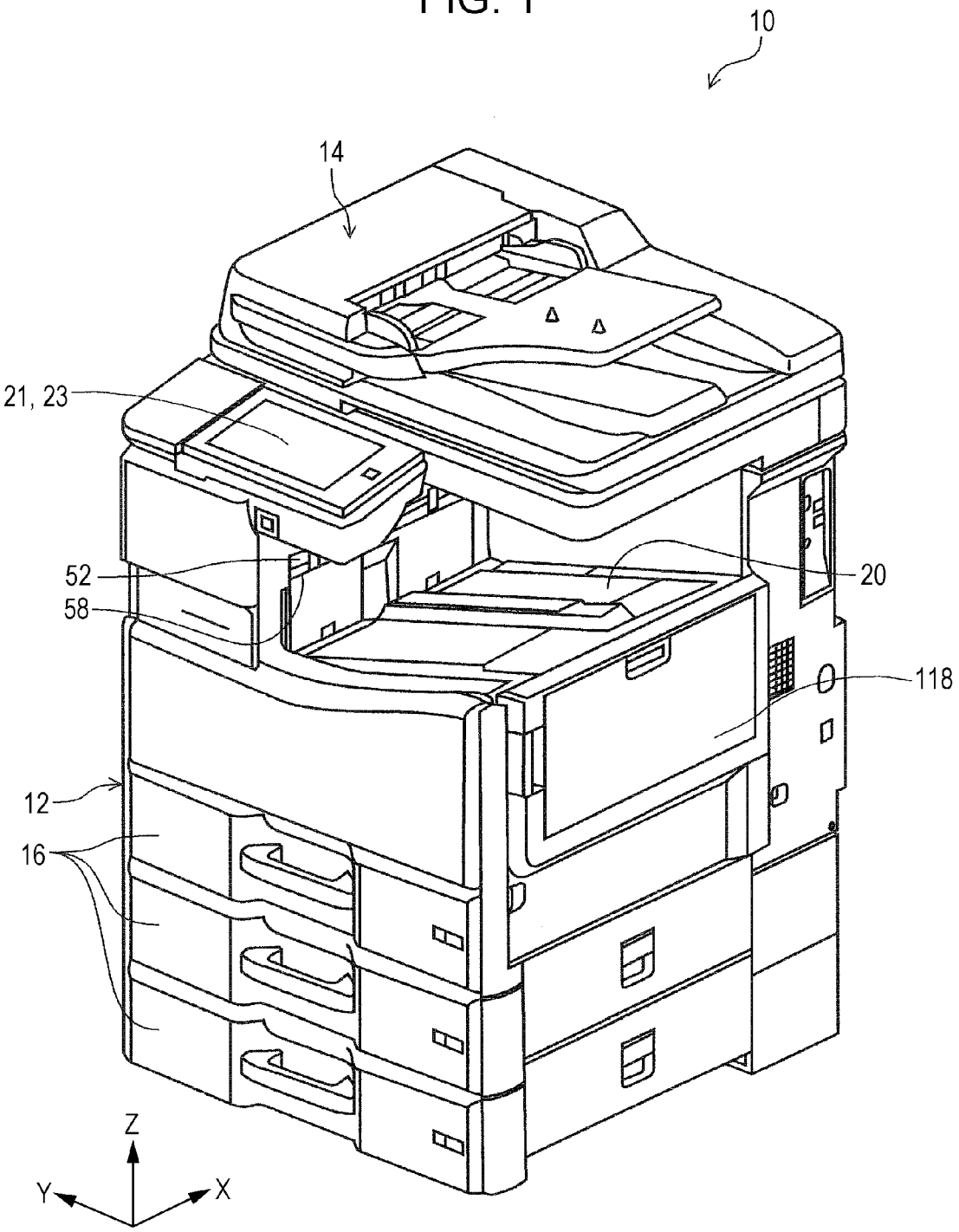
FIG. 1 is an external perspective diagram of a printer according to the invention.
Figure 2:
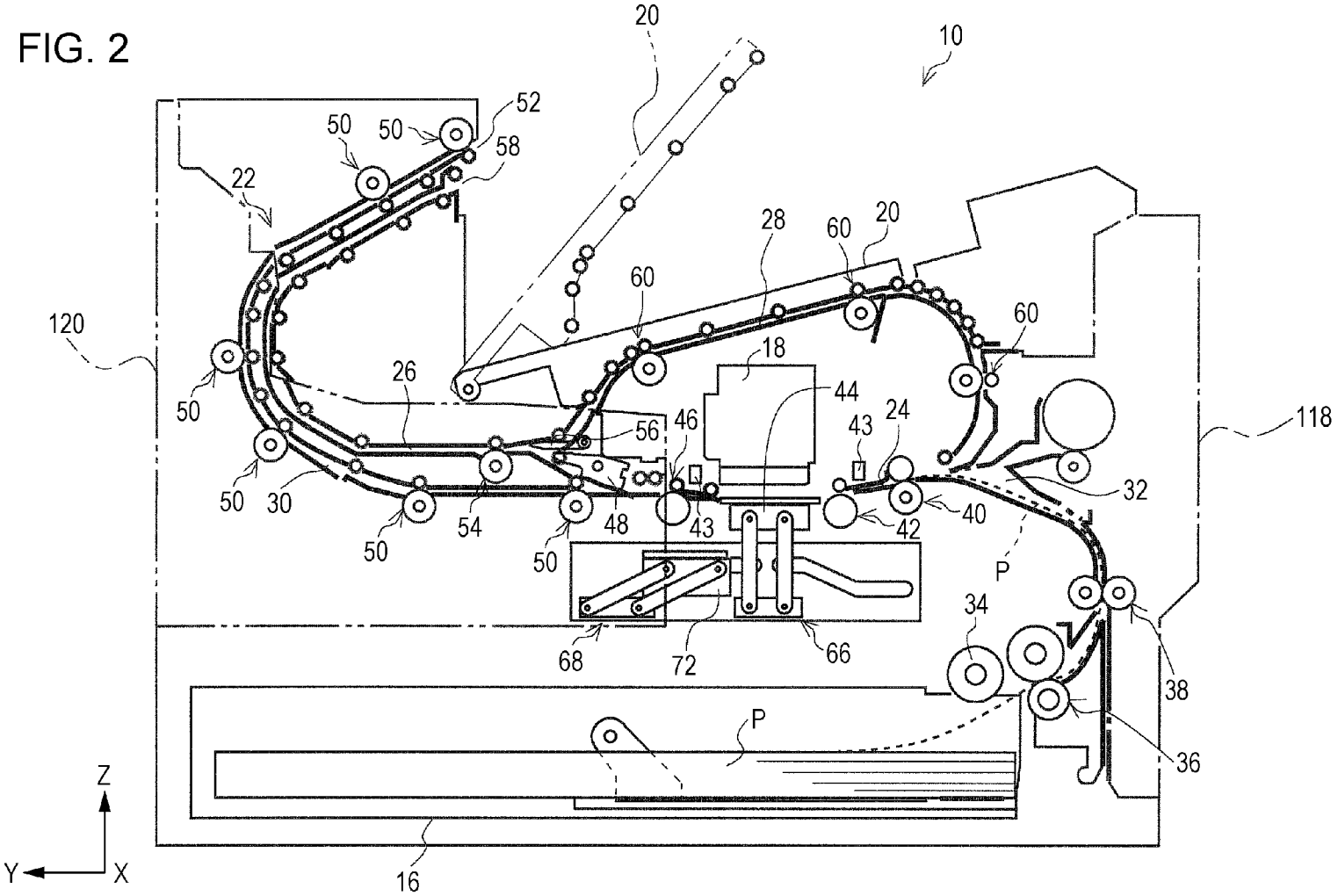
FIG. 2 is a side sectional diagram illustrating a paper transport path in the printer according to the invention.
Figure 3:
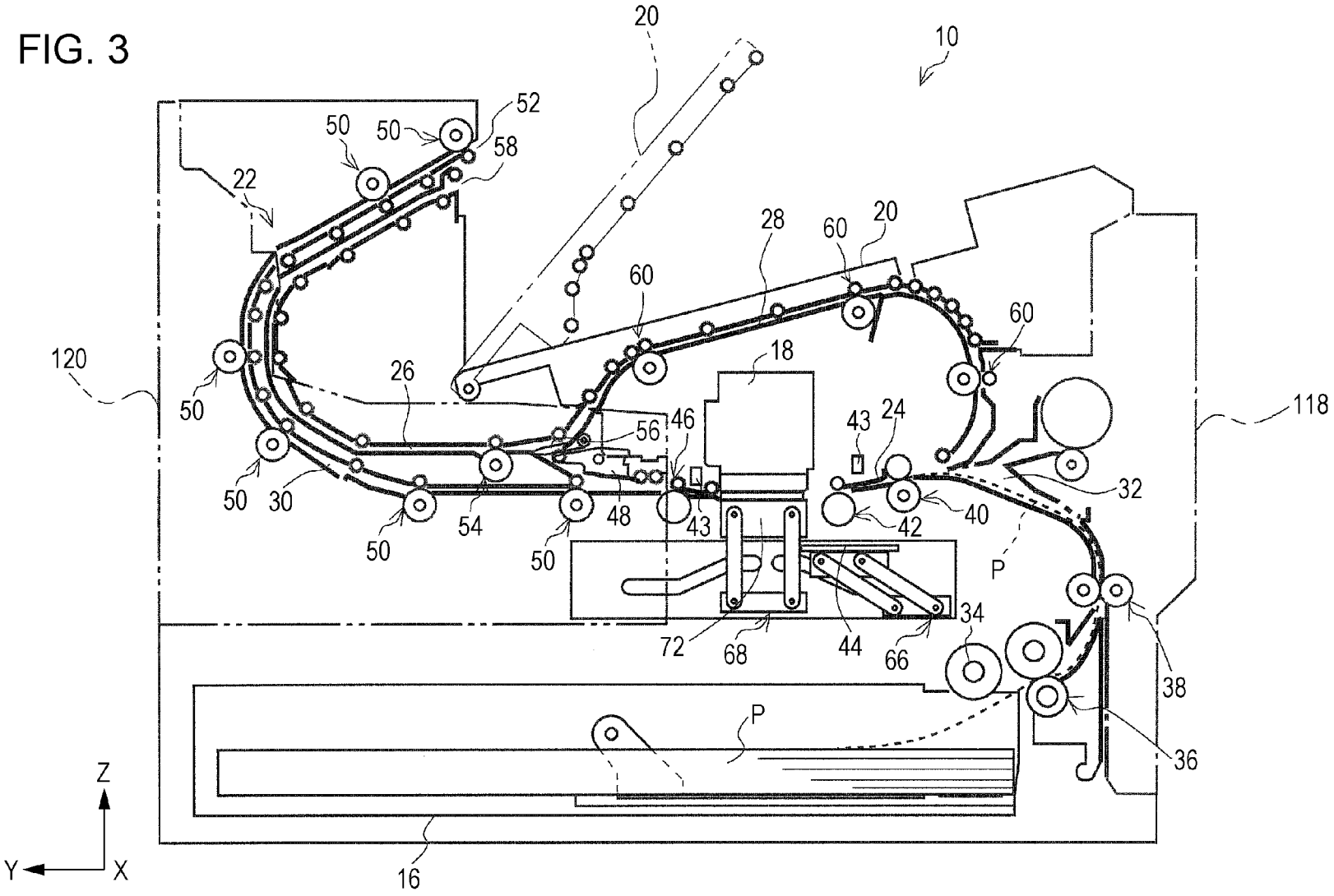
FIG. 3 is a side sectional diagram illustrating a state in which a line head is sealed by a cap section in the paper transport path.
Figure 4:
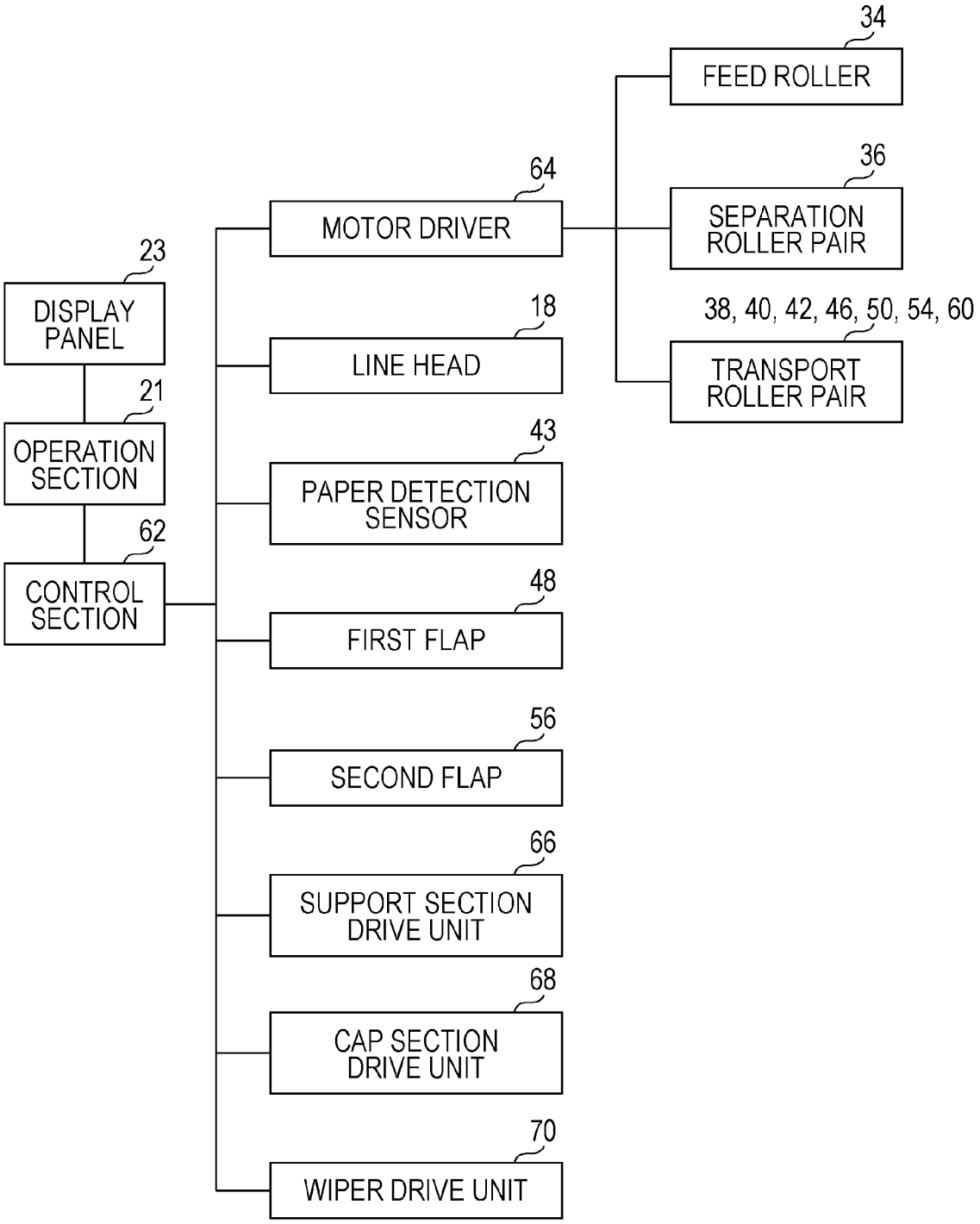
FIG. 4 is a block diagram of the printer according to the invention.
Figure 5:
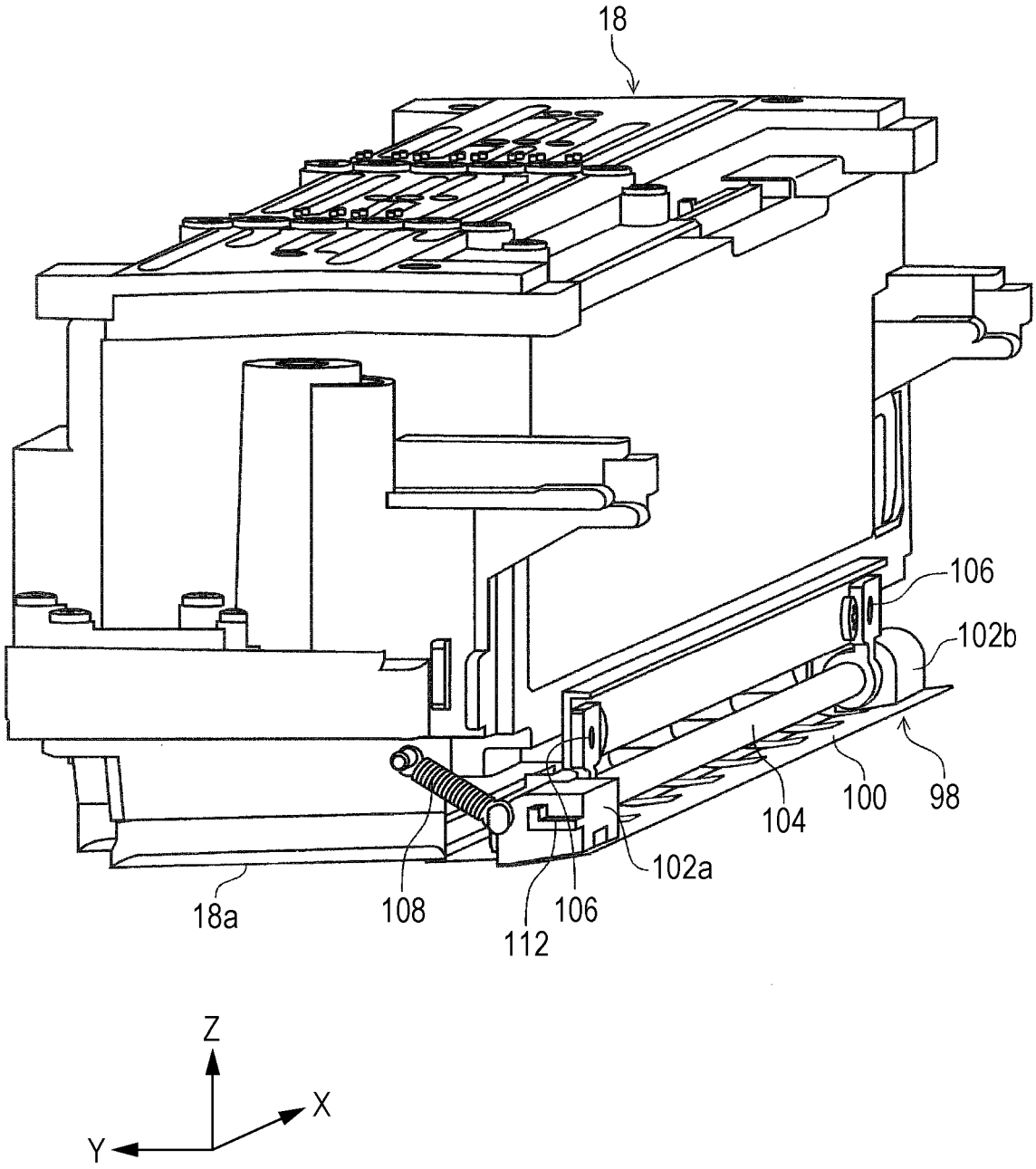
FIG. 5 is an external perspective diagram of the line head according to the invention.

FIG. 1 is an external perspective diagram of a printer according to the invention, FIG. 2 is a side sectional diagram illustrating a paper transport path in the printer according to the invention, FIG. 3 is a side sectional diagram illustrating a state in which a line head is sealed by a cap section in the paper transport path, FIG. 4 is a block diagram of the printer according to the invention, and FIG. 5 is an external perspective diagram of the line head according to the invention.

Figure 6:
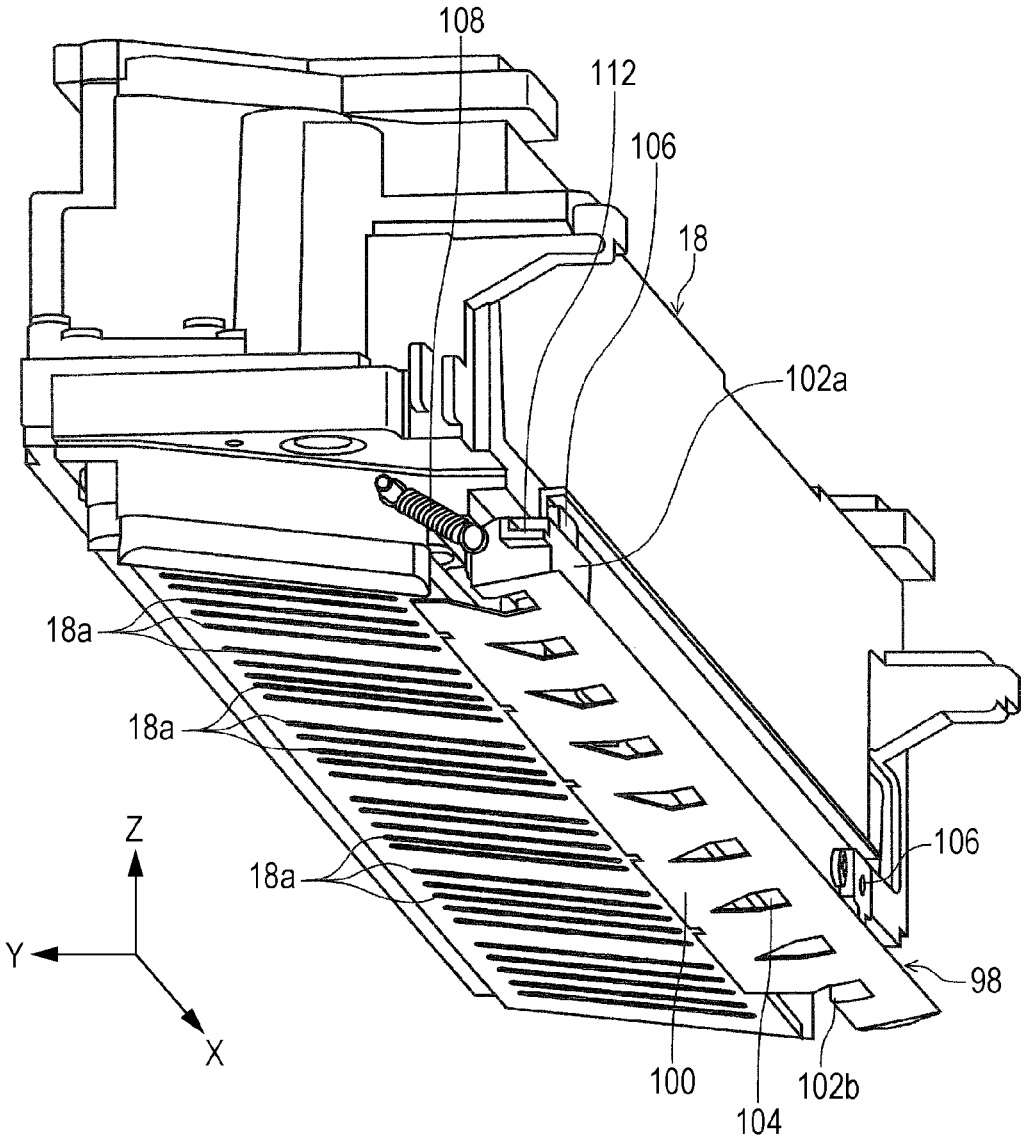
FIG. 6 is a perspective diagram of the line head according to the invention as viewed from a nozzle surface side.
Figure 7:
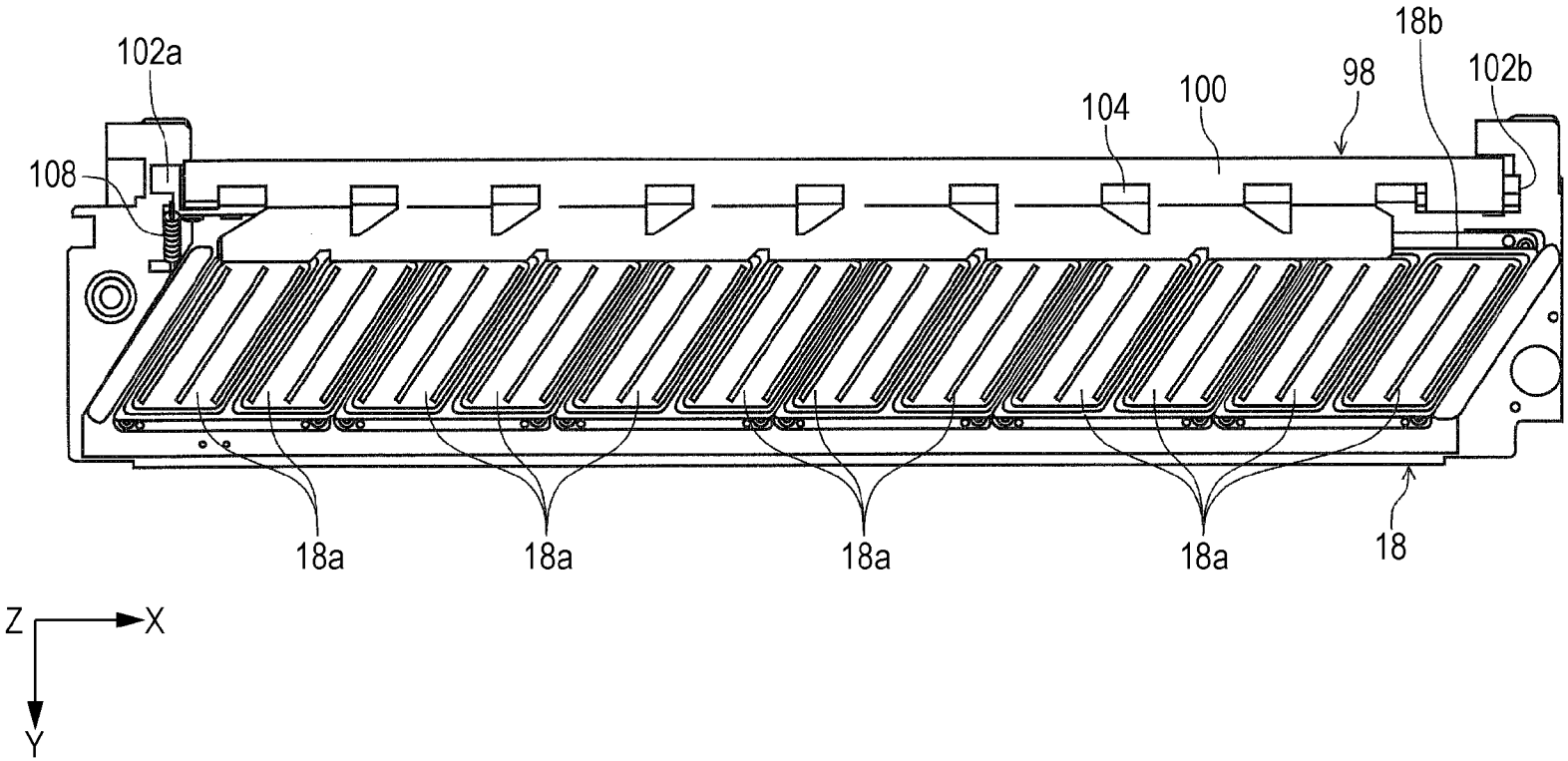
FIG. 7 is a plan diagram illustrating the relationship between the nozzle surface and a cover of the line head.
Figure 8:
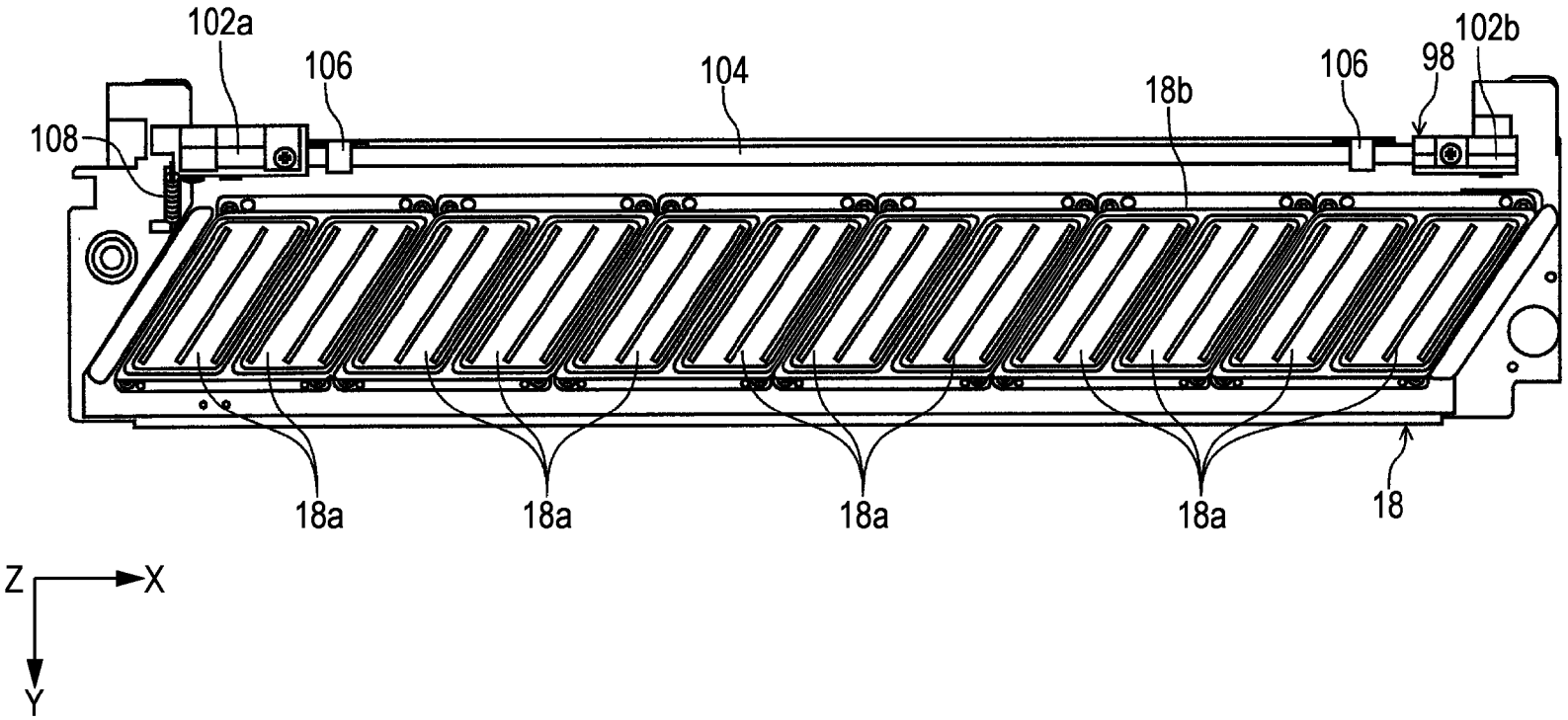
FIG. 8 is a plan diagram illustrating a state in which, in FIG. 7, the cover is removed from the line head.
Figure 9:
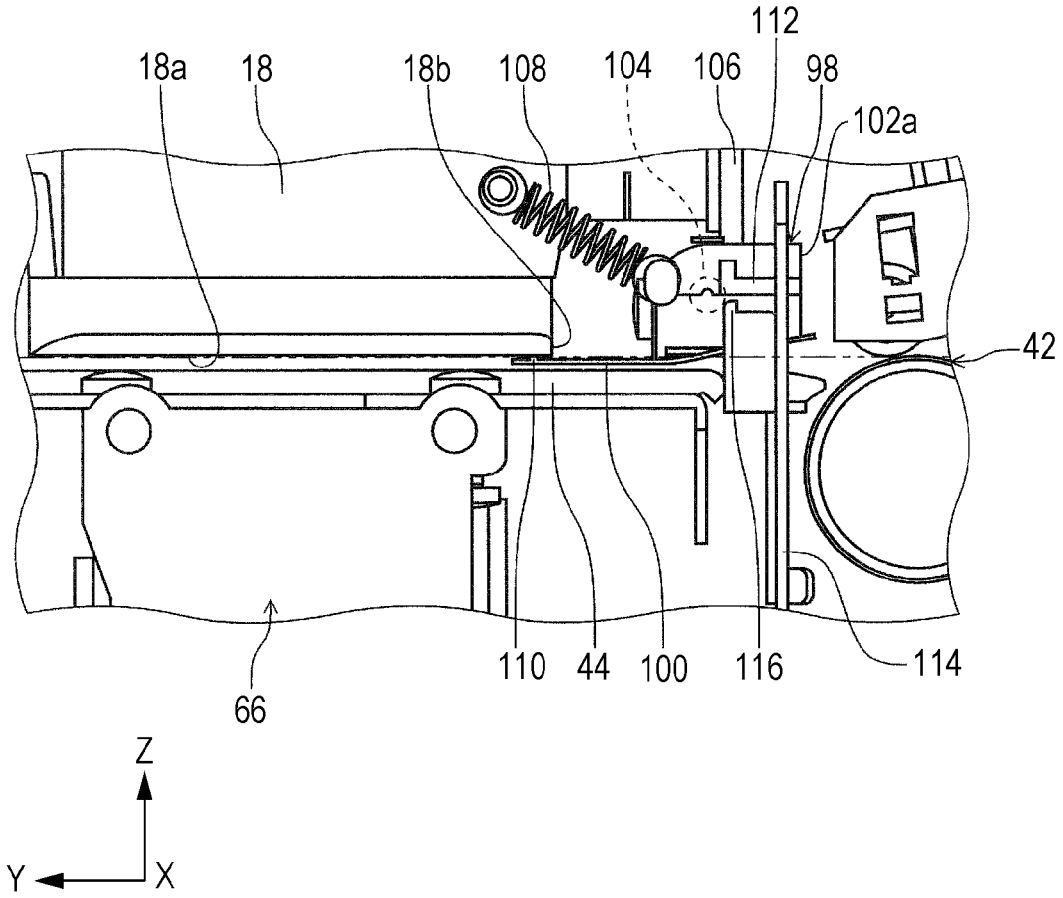
FIG. 9 is a side surface diagram illustrating a first state of the cover according to the invention.
Figure 10:
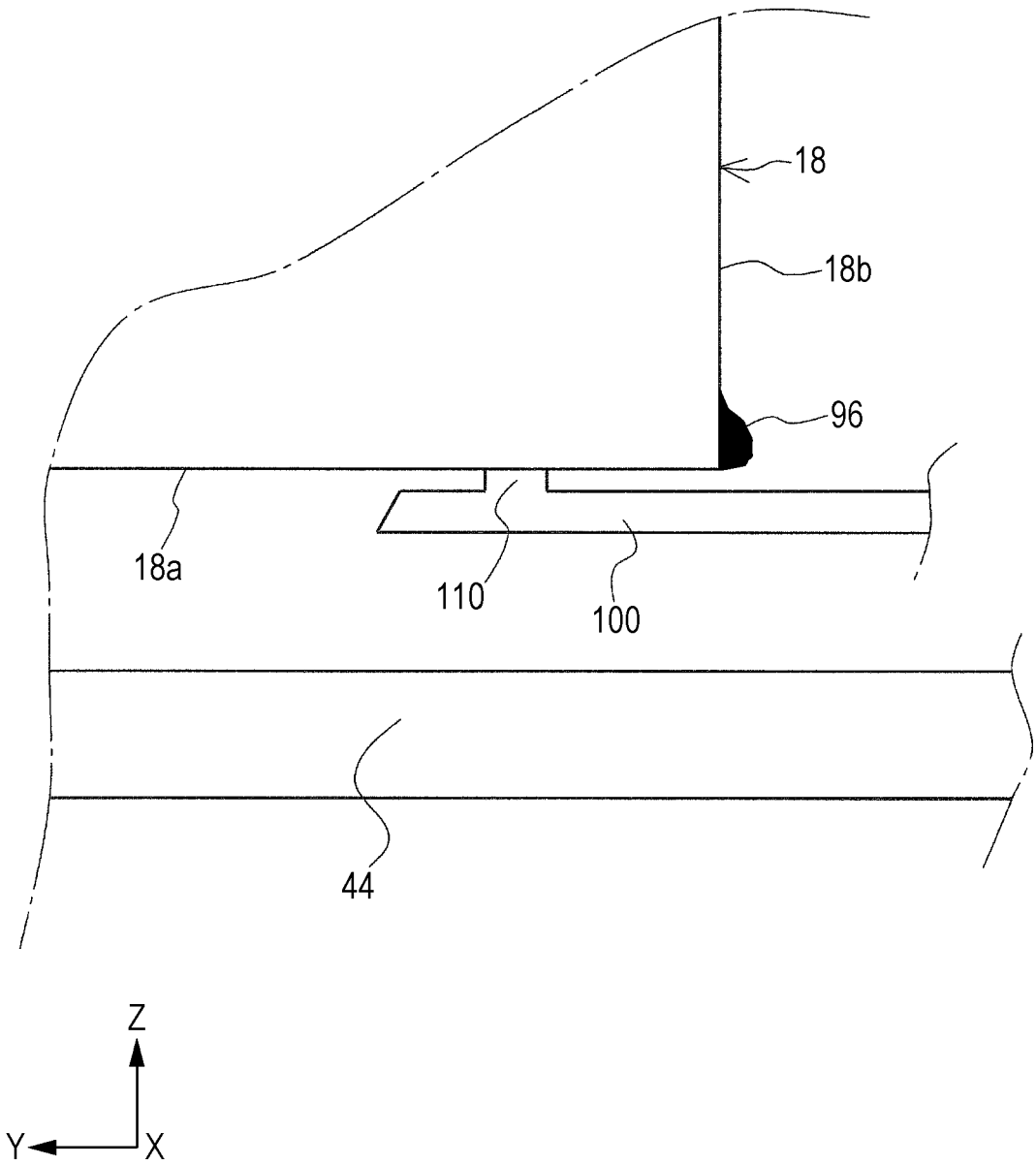
FIG. 10 is an enlarged diagram illustrating a portion of the cover which makes contact with the line head in FIG. 9.

FIG. 6 is a perspective diagram of the line head according to the invention as viewed from a nozzle surface side, FIG. 7 is a plan diagram illustrating the relationship between the nozzle surface and a cover of the line head, FIG. 8 is a plan diagram illustrating a state in which, in FIG. 7, the cover is removed from the line head, FIG. 9 is a side surface diagram illustrating a first state of the cover according to the invention, and FIG. 10 is an enlarged diagram illustrating a portion of the cover which makes contact with the line head in FIG. 9.

Figure 11A:
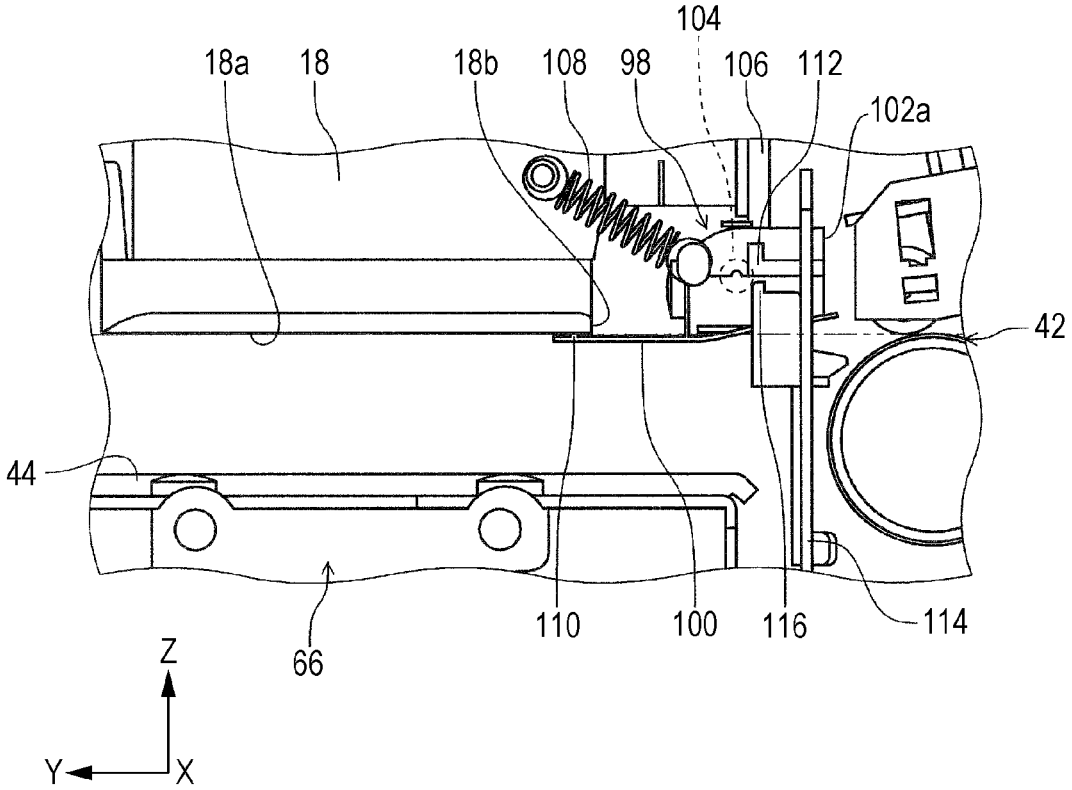
FIG. 11A is a side surface diagram illustrating a state in which a support section is separated from the line head.
Figure 11B:
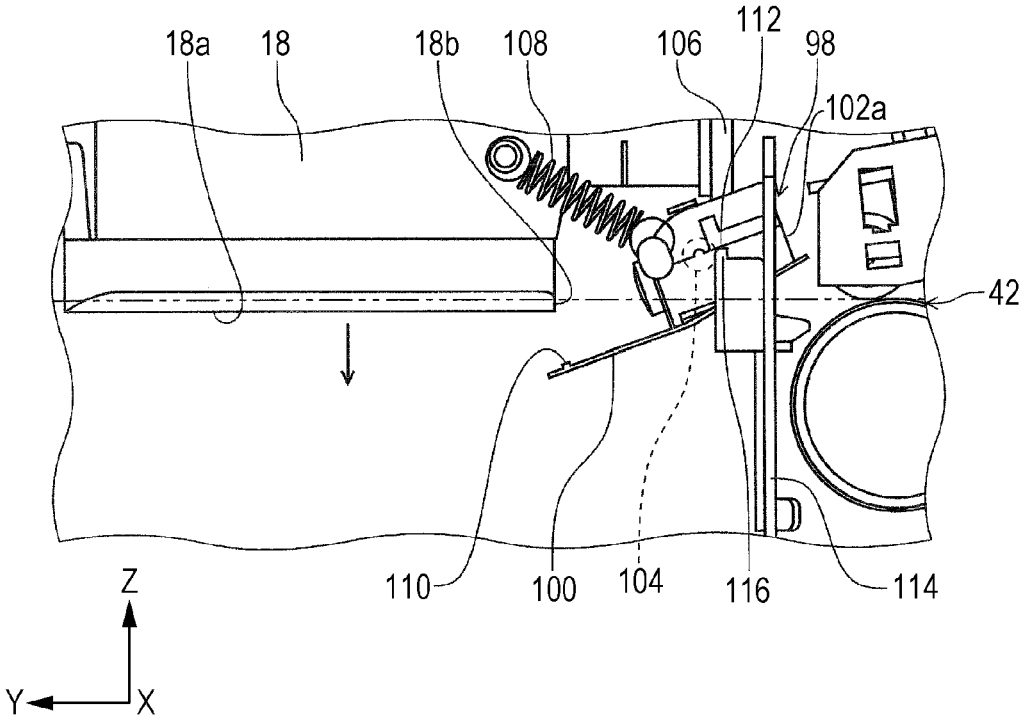
FIG. 11B is a side surface diagram illustrating a state in which the line head has begun a downward displacement.
Figure 12A:
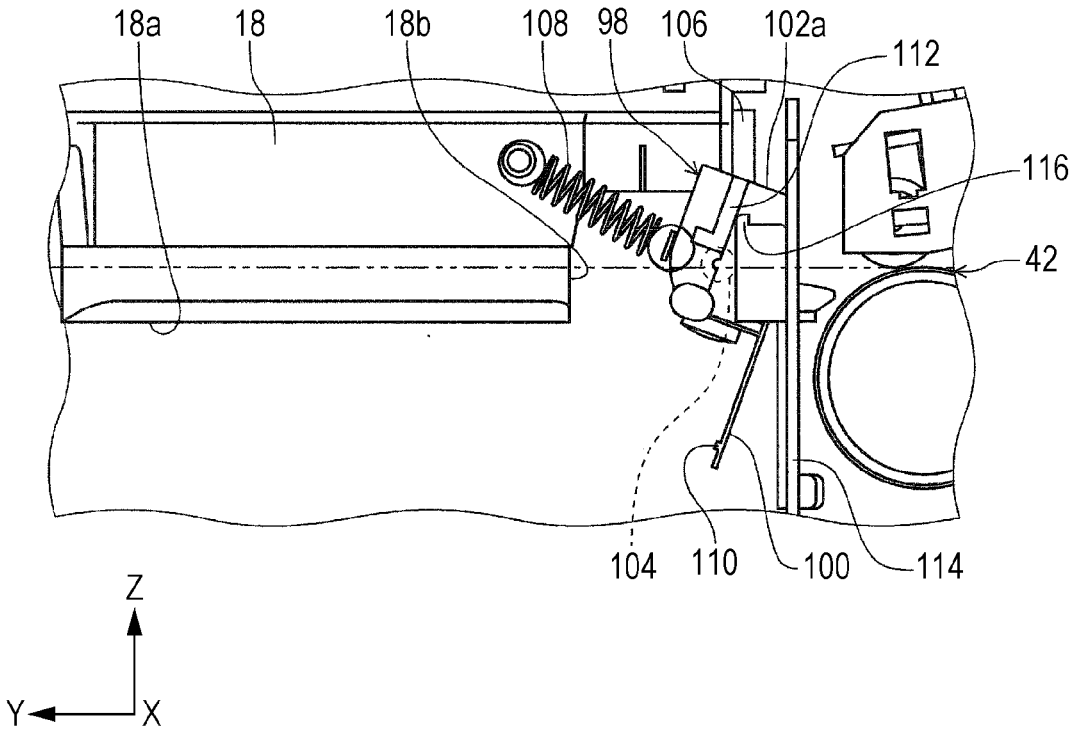
FIG. 12A is a side surface diagram illustrating a state in which the line head has completed the downward displacement.
Figure 12B:
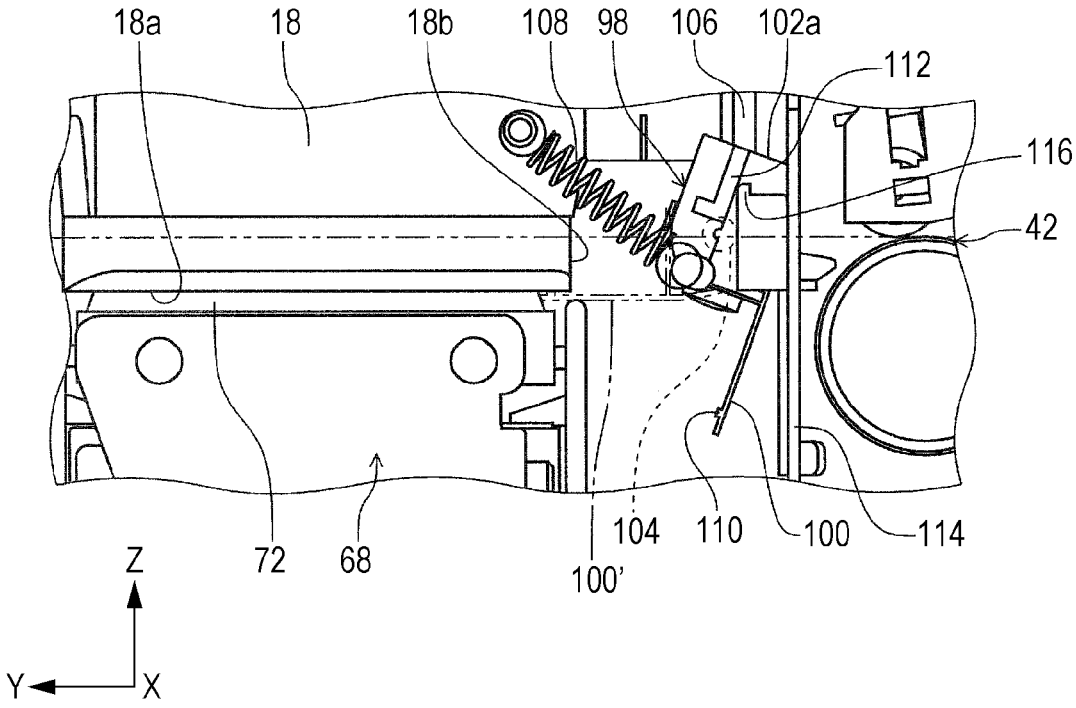
FIG. 12B is a side surface diagram illustrating a state in which the line head is sealed by the cap section.
Figure 13:
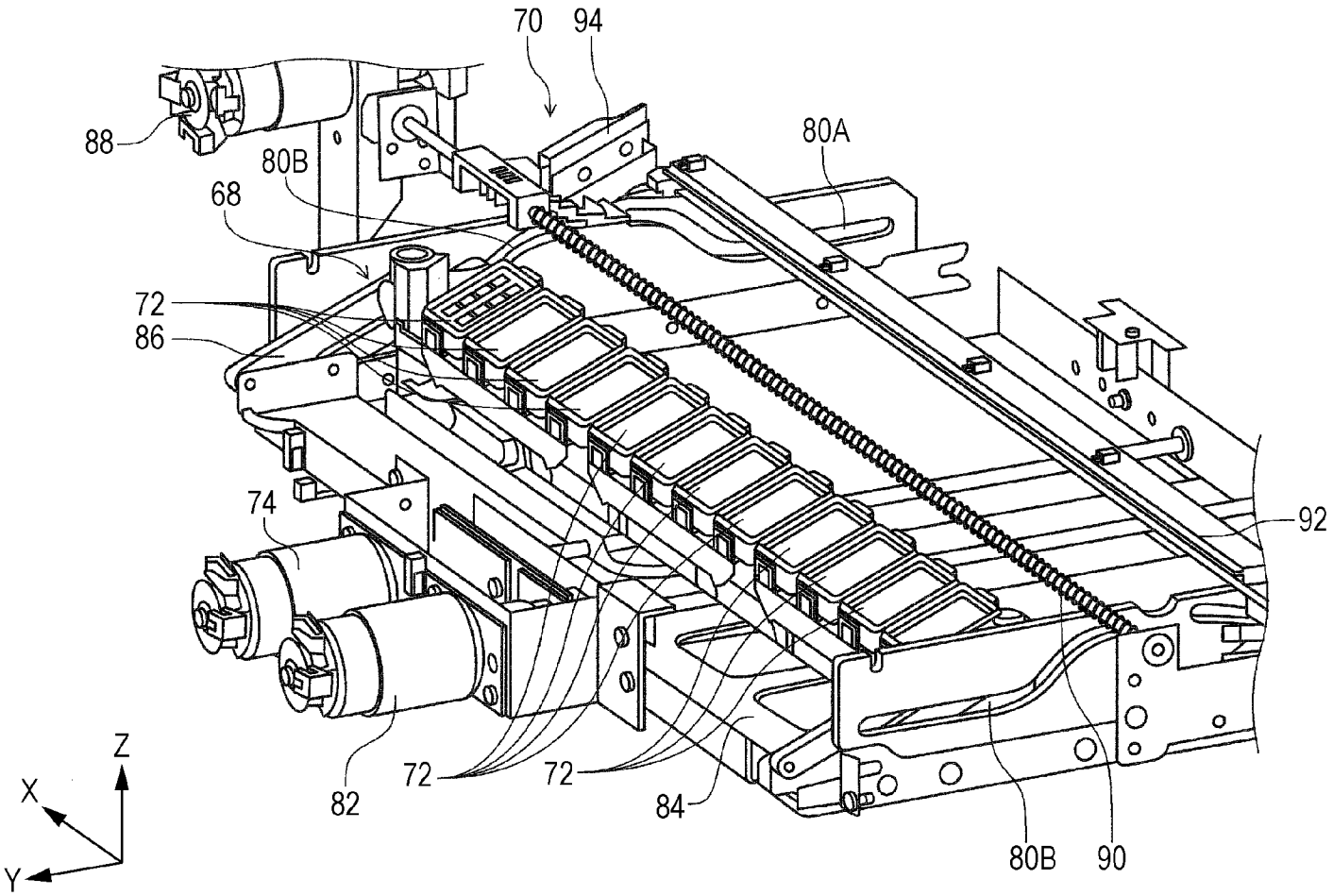
FIG. 13 is a perspective diagram illustrating a state before an operation of a wiper which is disposed in a position facing the line head.
Figure 14:
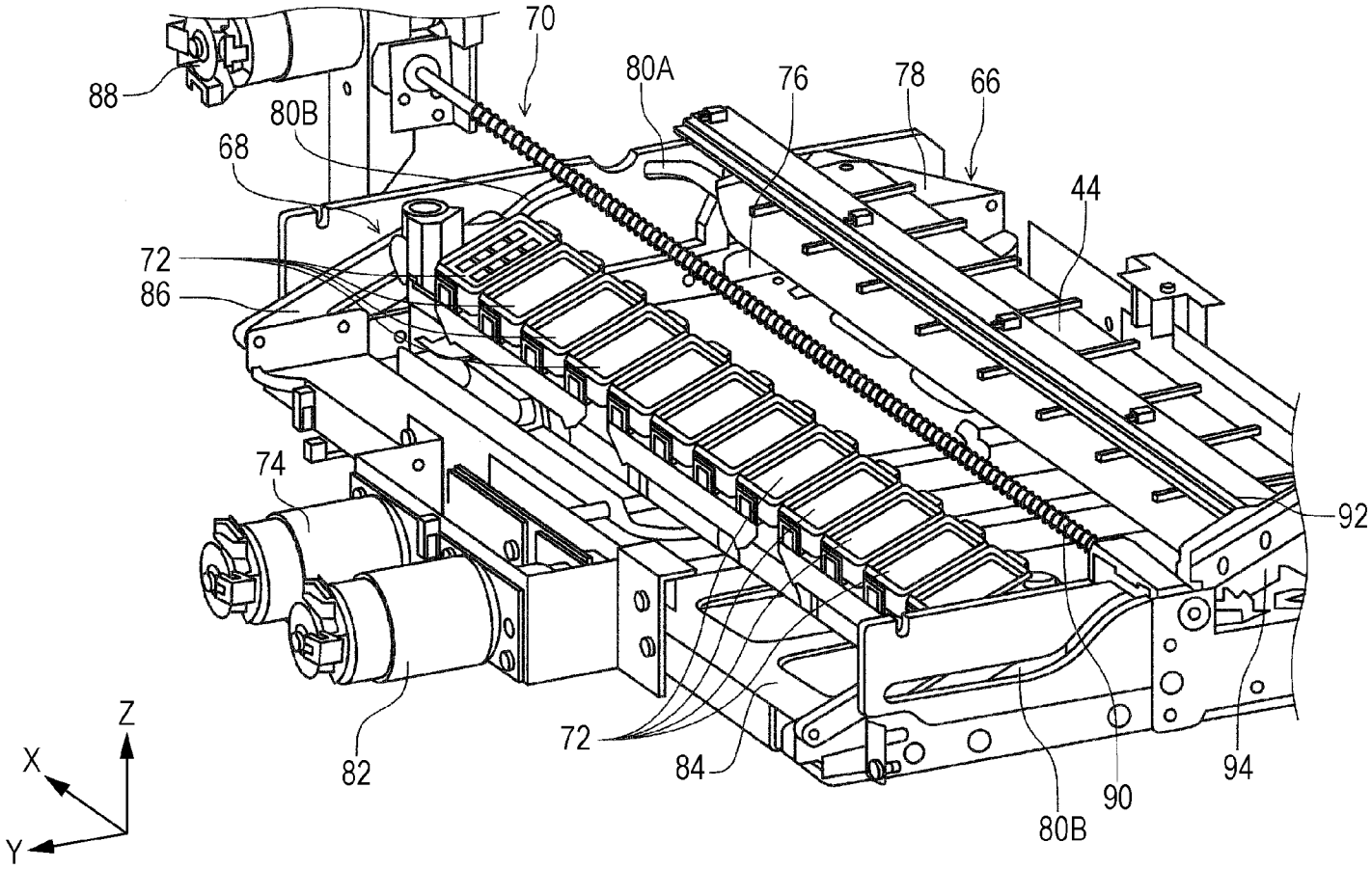
FIG. 14 is a perspective diagram illustrating a state after the operation of the wiper which is disposed in a position facing the line head.
Figure 15:
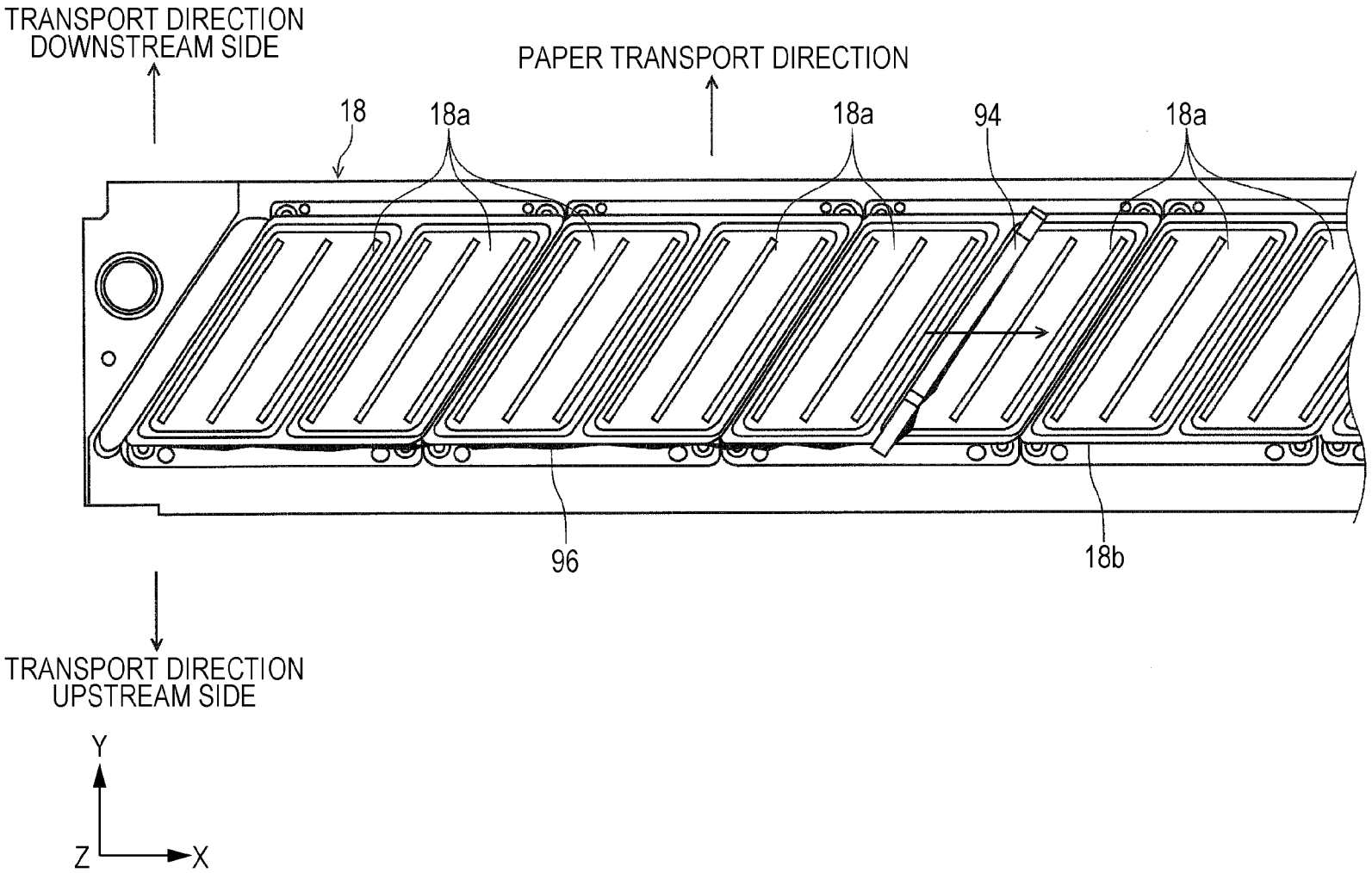
FIG. 15 is a plan diagram illustrating the operation state of the wiper in relation to the nozzle surface.
Figure 16:
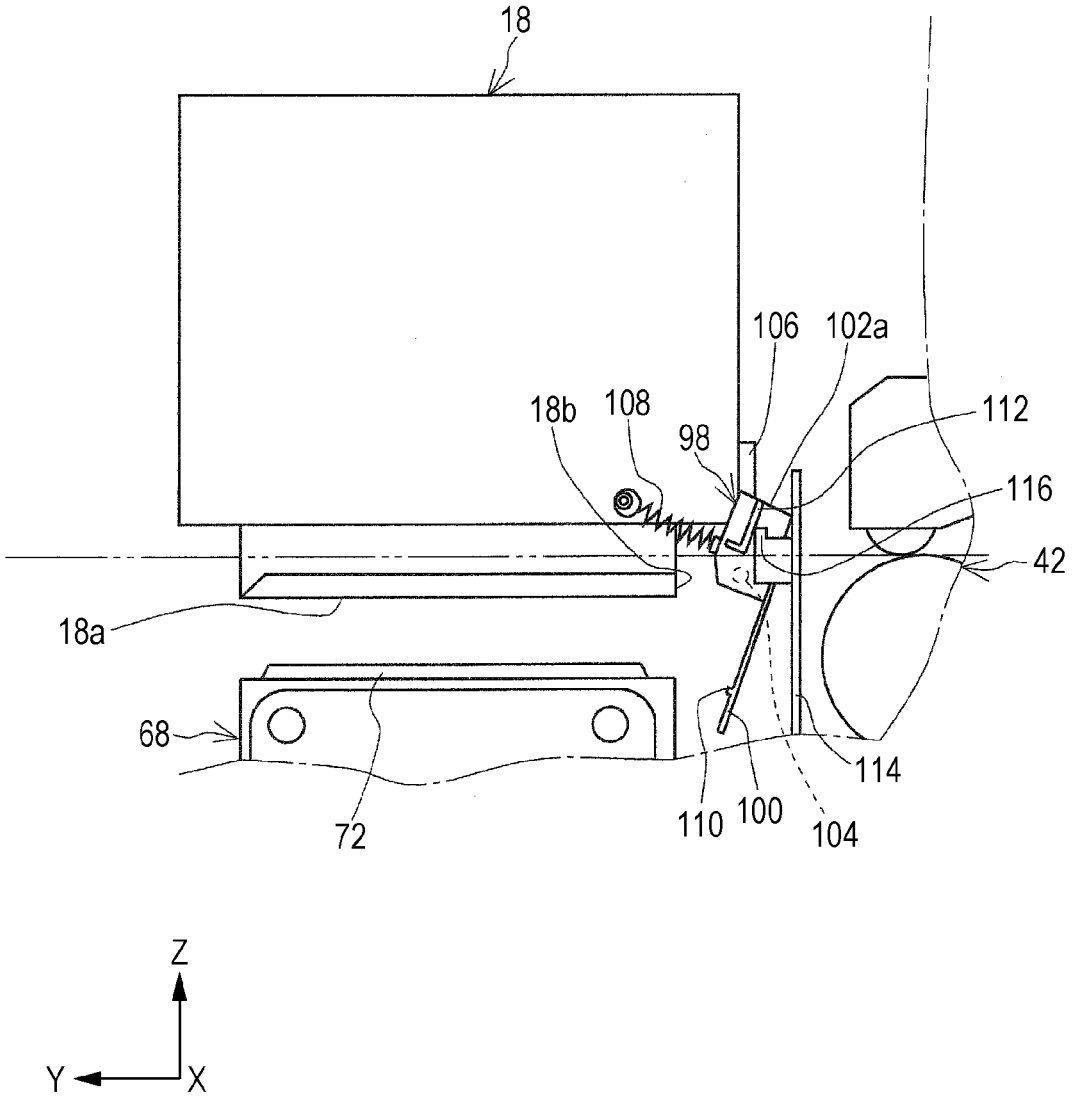
FIG. 16 is an explanatory diagram illustrating a flushing position of the cap section in relation to the line head.

FIG. 11A is a side surface diagram illustrating a state in which a support section is separated from the line head, FIG. 11B is a side surface diagram illustrating a state in which the line head has begun a downward displacement, FIG. 12A is a side surface diagram illustrating a state in which the line head has completed the downward displacement, FIG. 12B is a side surface diagram illustrating a state in which the line head is sealed by the cap section, FIG. 13 is a perspective diagram illustrating a state before an operation of a wiper which is disposed in a position facing the line head, FIG. 14 is a perspective diagram illustrating a state after the operation of the wiper which is disposed in a position facing the line head, FIG. 15 is a plan diagram illustrating the operation state of the wiper in relation to the nozzle surface, and FIG. 16 is an explanatory diagram illustrating a flushing position of the cap section in relation to the line head.

In the X-Y-Z coordinate system illustrated in the drawings, an X direction (an apparatus width direction) indicates a full width direction of the paper, a Y direction indicates a transport direction of the paper, and a Z direction indicates a direction in which the distance (the gap) between the recording head and the paper changes, that is, an apparatus height direction. Note that, in the drawings, the −X direction side is the apparatus front surface side, and the +X direction side is the apparatus rear surface side.

Outline of Printer

Description will be given of an ink jet printer 10 (hereinafter referred to as the printer 10) as an example of a liquid ejecting apparatus, with reference to FIG. 1. The printer 10 is configured as a multifunction device which is provided with an apparatus main body 12 and a scanner unit 14. The apparatus main body 12 is provided with a plurality of paper storage cassettes 16 which store paper P (refer to FIG. 2) which is a "recording medium". Each of the paper storage cassettes 16 is attached in a detachable manner to the front surface side (the −X axis direction side in FIG. 1) of the apparatus main body 12. Note that, the paper P in the present specification indicates, for example, paper such as ordinary paper, thick paper, photographic paper, and the like.

A paper receiving tray 20 which receives the paper P on which recording is executed by a line head 18 (described later) is provided between the scanner unit 14 and the paper storage cassettes 16 in the apparatus height direction (the Z axis direction) in the apparatus main body 12. An operation section 21 is provided on the front surface side of the apparatus main body 12. The operation section 21 is provided with a display panel 23. The display panel 23 in the present example is a display unit such as a liquid crystal panel or a touch panel. It is possible to input instructions of a recording operation and an image reading operation to the printer 10 by operating the operation section 21.

Regarding Paper Transport Path

Next, description will be given of the transport path of the paper P in the printer 10 with reference to FIG. 2. Note that, in FIG. 2, only the main constituent elements of the transport path of the paper P are given symbols, and the symbols of the other constituent elements, in particular, the plurality of spurs which are provided are omitted.

The printer 10 in the present example is provided with a paper transport path 22. The paper transport path 22 is formed of a straight path 24 as a "transport unit", a switchback path 26, an inversion path 28, a face-down output path 30 as an "output unit", and a feed path 32 which is connected from the paper storage cassette 16 to the straight path 24.

The feed path 32 is provided with a feed roller 34, a separation roller pair 36, and a transport roller pair 38 in order along the transport direction of the paper P. The feed roller 34 is rotationally driven by drive motors (not shown). The separation roller pair 36 performs the separation of the paper P by nipping the paper P. In the transport roller pair 38, one roller is configured as a drive roller which is rotationally driven by a drive motor (not shown), and the other roller is configured as a driven roller.

Note that, in the following description, one roller of the transport roller pair which features in the present specification is configured as a drive roller which is rotationally driven by a drive motor (not shown), and the other roller is configured as a driven roller.

The paper P which is stored in the paper storage cassette 16 is fed to the downstream side of the feed path 32 by the feed roller 34. The paper P which is fed by the feed roller 34 is sequentially nipped by the separation roller pair 36 and the transport roller pair 38, and is fed toward the downstream side of the feed path 32. A transport roller pair 40 is provided on the downstream side of the transport roller pair 38 in the transport direction.

In the present example, the feed path 32 is connected to the straight path 24 at the position of the transport roller pair 40. In other words, the feed path 32 is set as a path from the paper storage cassette 16 to the transport roller pair 40.

The straight path 24 is configured as a path which extends in a straight line shape. In order along the transport direction, the straight path 24 is provided with the transport roller pair 40, a transport roller pair 42, the line head 18 as a "recording head", a support section 44 as a "support unit" which supports the paper P at a position facing the line head 18, a transport roller pair 46, and a first flap 48. Note that, in the present example, the straight path 24 is set as a path from the transport roller pair 40 to the first flap 48. In other words, the straight path 24 is set as a path which passes the line head 18 and extends to the upstream side and the downstream side of the line head 18.

In the present example, paper detection sensors 43 and 43 are provided between the transport roller pair 40 and the transport roller pair 42 in the straight path 24, for example, and between the line head 18 and the transport roller pair 46. The paper detection sensors 43 and 43 are provided as "detection units" which detect the passage of the paper P.

In the present example, nozzle surfaces 18*a* are provided on the bottom portion of the line head 18, and ink ejecting nozzles are provided in the nozzle surfaces 18*a* as a plurality of "liquid ejecting nozzles". In the present example, when the paper P is transported to a region facing the nozzle surfaces 18*a*, the line head 18 is configured to execute recording by ejecting the ink as the "liquid" from the plurality of ink ejecting nozzles which are provided in the nozzle surfaces 18*a* onto a recording surface of the paper P. In the present example, the line head 18 is a recording head which is provided such that the ink ejecting nozzles cover the entire width direction of the paper, for example, and is configured as a recording head capable of recording on the entirety of the paper width without moving in the width direction of the paper.

The support section 44 is disposed in a region which faces the nozzle surfaces 18*a* of the line head 18. The support section 44 supports the opposite side from the recording surface of the paper P which is fed to the region which faces the nozzle surfaces 18*a* of the line head 18 using the transport roller pair 42. The recording surface of the paper P which is supported by the support section 44 faces the nozzle surfaces 18*a*, and recording is performed on the recording surface of the paper P due to the ink being ejected from the nozzles of the nozzle surfaces 18*a* of the line head 18. The support section 44 defines the distance (the gap) between the recording surface of the paper P and the nozzle surfaces 18*a* by supporting the paper P from below.

Next, the first flap 48 is positioned on the downstream side of the line head 18 in the transport direction. The first flap 48 is configured to be capable of rocking using a drive mechanism which is controlled by a control section 62 (refer to FIG. 4) which is described later. The first flap 48 is configured to be capable of switching between an orientation in which the straight path 24 is connected to the switchback path 26 (the state of FIG. 2), and an orientation in which the straight path 24 is connected to the face-down output path 30 (the state of FIG. 3). Note that, in the present example, the drive mechanism which drives the first flap 48 is configured using a solenoid. An orientation switching operation of the first flap 48 is controlled by the control section 62 (refer to FIG. 4).

In a case in which the first flap 48 is in the orientation in which the straight path 24 is connected to the face-down output path 30 (refer to FIG. 3), the paper P is fed from the straight path 24 to the face-down output path 30 by the transport roller pair 46.

The face-down output path 30 inverts by bending while extending toward the top side from the straight path 24 in the apparatus height direction. A plurality of transport roller pairs 50 are provided at an appropriate interval in the transport direction in the face-down output path 30.

The path of the face-down output path 30 runs from the first flap 48 to an output port 52 which is positioned on the downstream side in the transport direction of the transport roller pair 50 which is positioned on the most downstream side in the transport direction. In other words, the face-down output path 30 is a transport path which connects to the straight path 24, and is a path which causes the paper P which has passed the line head 18 to be inverted by being bent and to be output.

The paper P in which recording is executed on the recording surface by the line head 18 is transported by being sequentially nipped by the transport roller pairs 50 which are provided in order along the transport direction from the first flap 48 in the face-down output path 30. The paper P is output from the output port 52 toward the paper receiving tray 20.

Here, when the paper P is transported in the face-down output path 30, finally, the paper P is transported with the recording surface which is recorded on by the line head 18 facing upward, next, the paper P is transported with the recording surface bent toward the inside of a bending portion of the face-down output path 30, and the paper P is output from the output port 52 toward the paper receiving tray 20 with the recording surface facing downward.

Regarding Transport Path of Paper in Duplex Recording

In a case in which the first flap 48 is in the orientation in which the straight path 24 is connected to the switchback path 26 (refer to FIG. 2), the paper P is fed from the straight path 24 to the switchback path 26 by the transport roller pair 46.

The switchback path 26 and the inversion path 28 are paths through which the paper P passes in a case in which recording is executed on a second surface, that is, in a case in which the duplex recording is executed after the recording on a first surface of the paper P. Note that, in a case in which recording is performed on the second surface without performing recording on the first surface, the paper P passes through the switchback path 26 and the inversion path 28 in the same manner. In other words, in the present specification, duplex recording means inverting the paper P and performing recording on the second surface regardless of whether or not recording is performed on the first surface.

The switchback path 26 is positioned on the inside of the face-down output path 30 which inverts by bending upward in the apparatus height direction, and the switchback path 26 extends along the face-down output path 30.

The switchback path 26 is provided with a transport roller pair 54.

In the present example, the switchback path 26 is set as a path from a second flap 56 which is provided above the first flap 48 to an opening 58 which is provided in the tip of the switchback path 26. When the switchback path 26 is connected to the straight path 24 by the first flap 48 (refer to FIG. 2), the paper P is fed by the transport roller pair 46 from the region which faces the line head 18, via the first flap 48, into the switchback path 26. The paper P is fed to a position at which the trailing end portion thereof in the transport direction is nipped by the transport roller pair 54 in the switchback path 26.

Note that, here, description will be given of the second flap 56. The second flap 56 is provided above the first flap 48 in the apparatus height direction (the Z axis direction). The second flap 56 is caused to rock in accordance with the operation of the first flap 48 by a linking mechanism (not shown). In other words, the second flap 56 is controlled by the control section 62 via the first flap 48 and the linking mechanism.

In a state in which the first flap 48 connects the straight path 24 to the switchback path 26 (refer to FIG. 2), the second flap 56 assumes an orientation blocking the connection between the switchback path 26 and the inversion path 28. Meanwhile, in a state in which the first flap 48 connects the straight path 24 to the face-down output path 30 (refer to FIG. 3), the second flap 56 assumes an orientation connecting the switchback path 26 to the inversion path 28.

When the second flap 56 assumes the orientation connecting the switchback path 26 to the inversion path 28, the control section 62 causes the transport roller pair 54 to rotate in the opposite direction from the direction with which the paper P is fed into the switchback path 26, and feeds the paper P out to the inversion path 28 with the trailing end side of the paper P as the leading end side. In other words, the paper P is caused to switch back.

The inversion path 28 is set as a path which passes the second flap 56, over the line head 18 to reach the transport roller pair 40 of the straight path 24. In the inversion path 28, a plurality of transport roller pairs 60 are provided at an appropriate interval in the transport direction.

The exit side of the inversion path 28 is configured to merge with the straight path 24 at a position which is upstream of the transport roller pair 40 in the straight path 24. The paper P is re-fed into the straight path 24. In other words, the inversion path 28 is a transport path which connects to the switchback path 26, and is set as a path which inverts the paper P which is transported in the reverse direction, that is, the paper P which is switched back by bypassing the top side of the line head 18, and causing the paper P to rejoin the straight path 24 at the transport roller pair 40 which is positioned at an upstream side position of the line head 18.

When the paper P is transported in the inversion path 28, the first surface and the second surface are inverted, the paper P is transported to a region which faces the line head 18 in the straight path 24, and recording is executed on the second surface. Subsequently, the paper P passes the face-down output path 30 and is output to the paper receiving tray 20.

Referring to FIGS. 2 and 3, a single dot chain line portion which is assigned symbol 118 indicates an opening/closing unit which is capable of opening and closing in relation to the apparatus main body. The opening/closing unit 118 is capable of assuming a state of being closed in relation to the apparatus main body 12 illustrated in FIG. 1, and a state of being open in relation to the apparatus main body 12 (not shown).

The opening/closing unit 118 includes a rotational fulcrum (not shown) on the end portion of the +X axis direction side. The opening/closing unit 118 is configured to be capable of rotating around the rotational fulcrum relative to the apparatus main body 12.

Note that, in the present example, when the opening/closing unit 118 assumes the state of being open in relation to the apparatus main body, a portion of the feed path 32 and the inversion path 28 is exposed, and the driven rollers of the transport roller pairs 40 and 42 are configured to separate from the drive rollers.

In FIGS. 2 and 3, a double dot chain line which is assigned symbol 120 indicates a unit body capable of assuming a state in which the paper transport path 22 is formed in relation to the apparatus main body 12 (refer to FIG. 2), and a state in which the paper transport path 22 is opened (not shown). Note that, the state in which the paper transport path 22 is opened is a state in which the region which is surrounded by the double dot chain line in FIGS. 2 and 3 is pulled out from the apparatus main body 12 in the +Y axis direction in FIGS. 2 and 3. Note that, in the present example, when the unit body 120 assumes the second state, the driven roller in the transport roller pair 50 which is provided first on the downstream side, counting from the first flap 48 in the transport direction of the paper P, is configured to separate from the drive roller.

Regarding Control Section

The apparatus main body 12 is provided with the control section 62 (refer to FIG. 4) as an electrical circuit which is formed of a plurality of electronic components. The control section 62 controls the operations necessary for the execution of recording and image reading operations of the printer 10 such as feeding, transporting, and outputting of the paper P, paper detection, a recording operation, a document reading operation, and maintenance operations in the scanner unit 14, the line head 18, the operation section 21, the display panel 23, the paper detection sensors 43, the first flap 48, the second flap 56, a motor driver 64 (described later), a support section drive unit 66, a cap section drive unit 68, and a wiper drive unit 70.

The control section 62 may control the operations necessary for the execution of recording and image reading of the printer 10 such as a document reading operation using instructions from outside (a PC or the like). The control section 62 controls the ejecting of ink in the ink ejecting nozzles of the nozzle surfaces 18*a* of the line head 18.

A plurality of the motor drivers 64 which are controlled by the control section 62 are disposed inside the apparatus main body 12, and controls each of a plurality of drive motors (not shown). In other words, in the present example, the control section 62 controls the driving of the feed roller 34, the separation roller pair 36, and each of the transport roller pairs 38, 40, 42, 50, 54, and 60 via the motor drivers 64 and the plurality of drive motors.

Outline of Line Head

Referring to FIGS. 5 to 8, the line head 18 has a substantially rectangular parallelepiped shape in the present example, is configured to be capable of being attached to and detached from the apparatus main body 12, and a plurality of the nozzle surfaces 18*a* is provided on the bottom portion of the line head 18. As illustrated in FIG. 8, the plurality of nozzle surfaces 18*a* are provided to extend in the longitudinal direction of the line head 18 on the bottom portion of the line head 18. The plurality of nozzle surfaces 18*a* is arranged to be inclined to the longitudinal direction of the line head 18 in relation to the paper transport direction. A plurality of minute ink ejecting nozzles are provided on the nozzle surfaces 18*a*.

Regarding Support Section, Cap Section, and Wiper

Here, before describing the example, description will be given of the ink accumulation which occurs at the rim portion of the nozzle surfaces 18*a* together with the wiping operation in the nozzle surfaces 18*a* of the line head 18. Description will also be given of the support section 44 which faces the nozzle surfaces 18*a* of the line head 18 during the recording operation of the printer 10 and supports the paper P, and a cap section 72 as a "receiving section" which seals the nozzle surfaces 18*a* during a non-recording operation of the printer 10 which are necessary for explaining the example.

Referring to FIGS. 2, 3, 13, and 15, the support section drive unit 66, the cap section drive unit 68, and the wiper drive unit 70 are provided below the line head 18. Note that, to facilitate description in FIG. 13, depiction of the support section drive unit 66 is omitted.

The support section drive unit 66 is provided with a moving table 76 which is capable of reciprocal movement in the paper transport direction due to a drive motor 74, a link mechanism 78 which is attached to the moving table 76, and the support section 44 which is attached to the link mechanism 78. The support section drive unit 66 is capable of switching between a state in which the support section 44 faces the nozzle surfaces 18*a* of the line head 18 (refer to FIG. 2), a state in which the support section 44 is withdrawn from the position facing the nozzle surfaces 18*a* (refer to FIGS. 3 and 14), and, in the present example, a state in which the support section 44 is withdrawn to the upstream side in the paper transport direction.

Specifically, when the moving table 76 is moved in the paper transport direction by the drive force of the drive motor 74, the link mechanism 78 is displaced along guide channels 80A (refer to FIGS. 13 and 14) which engage with the link mechanism 78. Due to this movement, the support section drive unit 66 switches between the state in which the support section 44 faces the nozzle surfaces 18*a* (refer to FIG. 2), and the state in which the support section 44 is withdrawn from the position facing the nozzle surfaces 18*a* (refer to FIGS. 3 and 14).

The cap section drive unit 68 is provided with a moving table 84 which is capable of reciprocal movement in the paper transport direction due to a drive motor 82, a link mechanism 86 which is attached to the moving table 84, and the cap section 72 which is attached to the link mechanism 86. The cap section drive unit 68 is capable of switching between a state in which the cap section 72 faces the nozzle surfaces 18*a* of the line head 18 (refer to FIG. 3), a state in which the cap section 72 is withdrawn from the position facing the nozzle surfaces 18*a* (refer to FIGS. 2 and 14), and, in the present example, a state in which the cap section 72 is positioned in a withdrawn position which is on the downstream side in the paper transport direction.

Specifically, when the moving table 84 is moved in the paper transport direction by the drive force of the drive motor 82, the link mechanism 86 is displaced along guide channels 80B (refer to FIGS. 13 and 14) which engage with the link mechanism 86. Due to this movement, the cap section drive unit 68 switches between the state in which the cap section 72 faces the nozzle surfaces 18*a* (refer to FIG. 2), and the state in which the cap section 72 is withdrawn from the position facing the nozzle surfaces 18*a* (refer to FIGS. 3 and 14).

Note that, in the present example, in the state in which the cap section 72 faces the line head 18, the cap section 72 is capable of assuming a first receiving position and a second receiving position in the apparatus height direction. Here, the first receiving position is a sealing position at which the cap section 72 seals the nozzle surfaces 18*a* of the line head 18 (refer to FIG. 12B), and the second receiving position is a position at which the cap section 72 faces the nozzle surfaces 18*a* of the line head 18 and the ink which is ejected from the nozzle surfaces 18*a* does not splash on the periphery of the cap section 72 (refer to FIG. 16). In the present example, the cap section 72 also functions as a flushing receiving section during a flushing operation.

Note that, in the present example, between the first receiving position (the cap sealing position) and the second receiving position (the flushing position), the first receiving position is set to be higher than the second receiving position in the apparatus height direction.

The control section 62 controls the support section drive unit 66 and the cap section drive unit 68, and in the recording operation state of the printer 10, drives the support section drive unit 66 such that the support section 44 is positioned in a position facing the line head 18. In the non-recording operation state of the printer 10, that is, the flushing operation state of the line head 18, the cap section drive unit 68 is driven such that the cap section 72 is positioned in the second receiving position (refer to FIG. 16), and in a sealing operation state, the cap section drive unit 68 is driven such that the cap section 72 is positioned in the first receiving position which seals the nozzle surfaces 18*a* of the line head 18.

Note that, although described later, the line head 18 is configured to be capable of being displaced in the apparatus height direction. In the flushing operation state, the wiping operation state, and the cap sealing operation state, the line head 18 is displaced downward in the apparatus height direction in relation to the position in the apparatus height direction of the line head 18 in the recording operation state, and each of the operations is performed.

Description will be given of the wiper drive unit 70 with reference to FIGS. 13 to 15. The wiper drive unit 70 is provided in a region which faces the nozzle surfaces 18*a* below the line head 18. The wiper drive unit 70 is provided with a drive motor 88, a feed member 90 which is rotationally driven by the drive motor 88 and is provided to extend in the longitudinal direction (the apparatus depth direction) of the line head 18, a guide member 92 which extends parallel to the feed member 90, and a wiper 94. Note that, in the present example, the feed member 90 is configured by providing a spiral-shaped ridge on a shaft-shaped member, and functions as a feed screw.

One end of the wiper 94 is attached to the feed member 90, and the other end is attached to the guide member 92. In the present example, the wiper 94 is configured as a plate-shaped member. When the drive motor 88 is rotationally driven, the feed member 90 rotationally drives. Due to this rotational driving, the wiper 94 reciprocally moves in the longitudinal direction (the apparatus depth direction) of the line head 18 along the spiral-shaped ridge which is provided on the feed member 90.

At this time, the guide member 92 guides the movement of wiper 94 in the longitudinal direction of the line head 18. Note that, FIG. 13 illustrates the standby position of the wiper 94, and the standby position of the wiper 94 is provided in a position which is distanced from the paper transport region in the paper transport path 22 in the apparatus depth direction. FIG. 14 illustrates a state in which the wiper 94 has completed the wiping operation of the nozzle surfaces 18*a* of the line head 18.

Here, as illustrated in FIGS. 14 and 15, in the paper transport direction (the Y axis direction), the wiper 94 inclines toward the apparatus rear surface side as the wiper 94 heads from the downstream side in the transport direction (the +Y axis direction side) toward the upstream side in the transport direction (the −Y axis direction side). As illustrated in FIG. 15, when the wiper 94 is moved from the apparatus depth direction rear surface side to the front surface side in a state in which the wiper 94 is in contact with the nozzle surfaces 18*a* of the line head 18, that is, when a wiping operation is performed, the ink which is adhered to the nozzle surfaces 18*a* is scraped off by the wiper 94.

As a result, the scraped ink is allowed to move to the upstream side in the transport direction along the inclined front surface of the wiper 94 together with the wiping operation of the wiper 94. The ink which is accumulated on the upstream side of the transport direction in the wiper 94 forms an ink accumulation 96 on a rim portion 18*b* of the upstream side of the nozzle surfaces 18*a* of the line head 18 in the paper transport direction. Note that, in FIG. 15, the black portion which is assigned symbol 96 indicates the ink accumulation which is formed on the rim portion 18*b*.

For example, when the recording operation has been executed for 30 seconds in the printer 10, the support section 44 is switched from the state of facing the line head 18 to the state of being withdrawn from the line head 18, and instead, the cap section 72 is switched from a position at which the cap section 72 is withdrawn from the line head 18 to the second receiving position at which the cap section 72 faces the line head 18. A flushing operation in which the ink is ejected from the plurality of ink ejecting nozzles which are provided in the nozzle surfaces 18*a* of the line head 18 toward the cap section 72 is performed.

The wiping operation is performed in a state in which the cap section 72 has returned once to the withdrawn position after the flushing operation. In the present example, the wiping operation is set to be performed for every flushing operation, or alternatively, after the flushing operation has been performed a plurality of times.

Example

Taking the above description into account, description will be given again of the example with reference to FIGS. 5 to 12B. As illustrated in FIGS. 5 to 7, in the present example, a cover drive unit 98 is provided on the end portion of the upstream side of the line head 18 in the paper transport direction. The cover drive unit 98 is provided with a cover 100, cover attachment members 102*a* and 102*b*, a rotating shaft 104, rotating shaft support members 106 and 106, and a biasing member 108.

Each of the rotating shaft support members 106 and 106 is attached to the end portion of the upstream side of the line head 18 in the paper transport direction, leaving an interval in the longitudinal direction of the line head 18, that is, the apparatus depth direction. The rotating shaft support members 106 and 106 support the rotating shaft 104 which extends in the apparatus depth direction such that the rotating shaft 104 is capable of rotating. Each of the cover attachment members 102*a* and 102*b* is attached to either end portion of the rotating shaft 104.

The cover 100 which extends in the apparatus depth direction, that is, the longitudinal direction of the line head 18 is attached to the cover attachment members 102*a* and 102*b*. One end of the biasing member 108 is attached to the cover attachment member 102*a* and the other end of the biasing member 108 is attached to the line head 18. In the present example, the biasing member 108 is configured as a spring member.

In other words, the cover 100 is capable of rotating via the cover attachment members 102*a* and 102*b* using the rotating shaft 104 as a rotational fulcrum. As illustrated in FIG. 7, in the first state (described later), the cover 100 covers at least a portion of the rim portion 18*b* of the upstream side of the nozzle surfaces 18*a* of the line head 18 in the paper transport direction. In other words, in the first state, the cover 100 covers the ink accumulation 96 which is formed of ink which is accumulated on the rim portion 18*b*.

Next, description will be given of the rotation operation of the cover 100 with reference to FIGS. 9 to 12B and 16. The cover 100 is configured to be capable of rotating using the rotating shaft 104 as a rotational fulcrum, and is capable of switching by rotating between the first state illustrated in FIG. 9 and the second state illustrated in FIG. 12B. Note that, the straight double dot chain line in FIGS. 9 to 12B and 16 indicates the position in the apparatus height direction of the nozzle surfaces 18*a* of the line head 18 in a recording-capable state.

Description will be given of the first state of the cover 100 with reference to FIGS. 9 and 10. The first state of the cover 100 refers to a state in which the nozzle surfaces 18*a* of the line head 18 are in contact with at least a portion of the cover 100. Here, the cover 100 is provided with a protruding section 110 which protrudes toward the nozzle surfaces 18*a* from the cover 100 at the tip of the cover 100 in the first state, that is, at a region which faces the nozzle surfaces 18*a*.

In the present example, the protruding section 110 is in contact with the nozzle surfaces 18*a* as illustrated in FIG. 10. Therefore, in the cover 100, this does not mean that the entirety of the portion of the cover 100 in the first state which faces the nozzle surfaces 18*a* makes contact with the nozzle surfaces 18*a*, and the cover 100 covers the rim portion 18*b* of the upstream side of the nozzle surfaces 18*a* in the paper transport direction in a state in which a predetermined interval between the cover 100 and the nozzle surfaces 18*a* in the apparatus height direction is defined by the nozzle surfaces 18*a* making contact with the protruding section 110. Therefore, it is possible to prevent the ink which is adhered to the rim portion 18*b* from adhering to the cover 100.

The biasing member 108 which is disposed between the line head 18 and the cover attachment member 102*a* biases the cover 100 via the cover attachment member 102*a* such that the cover 100 pushes on the nozzle surfaces 18*a*.

In the first state of the cover 100, the nozzle surfaces 18*a* of the line head 18 face the support section 44 which supports the paper P. In other words, the first state of the cover 100 is a state in which the paper P is transported along the paper transport path 22 and it is possible to record in the region which faces the line head 18.

The cover 100 extends from the cover attachment members 102*a* and 102*b*, along the paper transport path 22, and to the rim portion 18*b* of the upstream side of the nozzle surfaces 18*a* of the line head 18 in the paper transport direction. As a result, the cover 100 functions as a guide member which guides the paper P when the paper P is transported from the transport roller pair 42 to the region which faces the nozzle surfaces 18*a* of the line head 18.

As illustrated in FIG. 9, a pushing-target section 112 is provided on the cover attachment member 102*a*. A pushing section 116 is provided on a frame 114 of the apparatus main body 12.

Next, referring to FIG. 11A, the control section 62 drives the support section drive unit 66, displaces the support section 44 downward in the apparatus height direction from the position which faces the nozzle surfaces 18*a* of the line head 18 via the predetermined interval (the gap), and causes the support section 44 to move to the predetermined withdrawn position (refer to FIG. 14).

When the support section 44 withdraws from the position facing the line head 18, the control section 62 causes the support section 44 begin a displacement to the bottom side of the line head 18 in the apparatus height direction. The cover drive unit 98 which is provided on the end portion of the upstream side of the line head 18 in the transport direction is also displaced, together with the line head 18, to the bottom side in the apparatus height direction with the displacement of the support section 44 to the bottom side of the line head 18 in the apparatus height direction.

Accordingly, the pushing section 116 which is provided on the frame 114 of the apparatus main body 12 engages with the pushing-target section 112 of the cover attachment member 102*a*. The pushing section 116 pushes the pushing-target section 112 upward in the apparatus height direction. As a result, the cover attachment member 102*a* begins to rotate in a counter clockwise direction in FIG. 11B against the biasing force of the biasing member 108, using the rotating shaft 104 as a rotational fulcrum. Accordingly, the cover 100 which was in contact with the nozzle surfaces 18*a* of the line head 18 separates from the nozzle surfaces 18*a* and rotates.

As illustrated in FIG. 12A, the cover drive unit 98 rotates the cover 100 in the counter clockwise direction in FIG. 11B according to the displacement of the line head 18 to the bottom side in the apparatus height direction. After the line head 18 has moved a predetermined distance which is set in advance to the bottom side in the apparatus height direction, the line head 18 stops moving in the apparatus height direction. Accordingly, the cover drive unit 98 also stops the rotation of the cover 100. Note that, in this state, since the pushing section 116 remains in a state of pushing the pushing-target section 112 of the cover attachment member 102*a*, the cover drive unit 98 maintains the rotational orientation of the cover 100 in relation to the line head 18. Note that, this state of the cover 100 is the second state of the cover 100.

The flushing operation, the cap sealing operation, and the wiping operation are performed when the line head 18 is in this position in the apparatus height direction. The rotation of the cover 100 in the cover drive unit 98 is performed together with the movement of the line head 18 in the apparatus height direction.

Since the movement of the line head 18 in the apparatus height direction is performed after the support section 44 or the cap section 72 is withdrawn from the position facing the line head 18, it is possible to prevent the cover 100 from interfering with the support section 44 or the cap section 72.

In a case in which the nozzle surfaces 18*a* of the line head 18 are to be sealed, as illustrated in FIG. 12B, when the movement of the line head 18 in the apparatus height direction is completed, the cap section drive unit 68 moves the cap section 72 from the predetermined withdrawn position (refer to FIG. 13), that is, from the position of the downstream side in the transport direction in the present example, to a position at which the cap section 72 faces the nozzle surfaces 18*a* of the line head 18, that is, to the first receiving position at which it is possible to seal the nozzle surfaces 18*a* of the line head 18. The cap section 72 is caused to abut the nozzle surfaces 18*a*, and the nozzle surfaces 18*a* are set to a sealed state.

In a case in which the flushing operation is to be executed in the line head 18, as illustrated in FIG. 16, when the movement of the line head 18 in the apparatus height direction is completed, the cap section drive unit 68 moves the cap section 72 from the predetermined withdrawn position (refer to FIG. 13), that is, from the position of the downstream side in the transport direction in the present example, to the second receiving position at which the cap section 72 faces the nozzle surfaces 18*a* of the line head 18 and receives the droplets of ink which are ejected from the ink ejecting nozzles. Then, the flushing operation is performed by ejecting the ink from the ink ejecting nozzles of the nozzle surfaces 18*a*.

When returning the line head 18 to the recording operation state (the state in FIG. 9) from the maintenance state (the state illustrated in FIGS. 12B and 16), using the cap section drive unit 68, the cap section 72 is caused to withdraw (refer to FIG. 12A) from the position facing the line head 18, that is, from the first receiving position (refer to FIG. 12B) or the second receiving position (refer to FIG. 16). The line head 18 is moved upward in the apparatus height direction (refer to FIG. 11B).

Since the pushing force of the pushing section 116 on the pushing-target section 112 weakens when the line head 18 is moved upward in the apparatus height direction, the cover drive unit 98 rotates the cover 100 in the second state in the clockwise direction of FIG. 11B using the biasing force of the biasing member 108. When the line head 18 returns to the position at which the recording operation is possible in the apparatus height direction (FIG. 11A), the protruding section 110 of the cover 100 makes contact with the nozzle surfaces 18*a*.

As a result, the rim portion 18*b* of the upstream side of the nozzle surfaces 18*a* in the transport direction assumes a state of being covered by the cover 100. In other words, the cover 100 assumes the first state. Due to the support section drive unit 66 moving the support section 44 from the withdrawn position (refer to FIG. 14) to the position facing the nozzle surfaces 18*a*, the recording operation in the line head 18 becomes possible.

Note that, in the present example, in a case in which the nozzle surfaces 18*a* of the line head 18 move lower than the position in the apparatus height direction of the support section 44 which is in a state of facing the nozzle surfaces 18*a* in the apparatus height direction, since the pushing section 116 is configured to make contact with the pushing-target section 112, in the recording state of the line head 18, that is, in the state in which the line head 18 faces the support section 44, the cover 100 maintains the first state even if the interval, that is, the gap between the line head 18 and the support section 44 is adjusted.

Referring again to FIG. 12B, the double dot chain line portion which is assigned symbol 100' indicates the cover 100 in the first state in relation to the line head 18. In this state, at least a portion of the cover 100 is in a position which interferes with the cap section 72 which is in the first receiving position (the sealing position). Although not depicted in the drawings, at least a portion of the cover 100 is also in a position which interferes with the support section 44 when the cover 100 is rotated in a state in which the support section 44 faces the nozzle surfaces 18*a*.

However, during the rotation operation of the cover 100, the cap section 72 and the support section 44 are withdrawn from the positions facing the line head 18 and do not interfere with the rotational track of the cover 100. As a result, it is possible to provide the cover 100 to extend sufficiently, and it is possible to more reliably cover the rim portion 18*b* of the upstream side of the nozzle surfaces 18*a* in the transport direction using the cover 100.

To summarize the above descriptions, according to the present example, since the cover 100 which is positioned between the paper P and the rim portion 18*b* of the nozzle surfaces 18*a* and covers the rim portions 18*b* of the nozzle surfaces 18*a* is provided, it is possible to reliably prevent the paper P from making contact with the ink accumulation 96 which is present on the rim portion 18*b* of the nozzle surfaces 18*a* using the cover 100, that is, it is possible to reliably prevent the paper P from being dirtied.

In the present example, since the receiving position of the cap section 72 is positioned on the movement track of the cover 100 between the first state and the second state, at least a portion of the cover 100 is in a position which interferes with the cap section 72 which is in a receiving position during the state switching. In other words, the cover 100 is provided to extend sufficiently, it is possible to secure the length of the cover 100, and, by more reliably covering the rim portion 18*b* of the nozzle surfaces 18*a*, it is possible to more reliably prevent the paper P from making contact with the ink accumulation 96. Since the cover 100 assumes the second state during the operation of the cap section 72, it is possible to smoothly perform the state switching of the cap section 72 without obstructing the operation of the cap section 72.

According to the present example, since the second receiving position is set to a position at which the ink droplets which are ejected during the flushing do not splash on the periphery of the cap section 72, it is possible to suppress the dirtying of the inside of the apparatus main body 12, that is, the paper transport path 22 of the paper P, in particular, by the ink droplets during the flushing, and it is possible to suppress a reduction in the recording quality of the paper P.

In the present example, since the cover 100 is configured to perform the state switching according to the proceeding and withdrawing operations of the line head 18, it is possible to configure the unit that performs the state switching of the cover 100 at low cost.

In the present example, since the support section 44 in the facing state is positioned on the movement track of the cover 100 between the first state and the second state, the cover 100 is in a position which interferes with the support section 44 which is in the facing state during the state switching. In other words, the cover 100 is provided to extend sufficiently, it is possible to secure the length of the cover 100, and, by more reliably covering the rim of the nozzle surfaces 18*a*, it is possible to more reliably prevent the paper P from making contact with the ink accumulation.

In the present example, since the cover 100 is provided with the protruding section 110 which protrudes toward the nozzle surfaces 18*a* and the protruding section 110 abuts the nozzle surfaces 18*a* in the state in which the rim portion 18*b* of the nozzle surfaces 18*a* is covered, it is possible to accurately define the position of the cover 100, it is possible to suppress, to a minimum, the contacting between the cover 100 and the nozzle surfaces 18*a*, and it is possible to suppress the dirtying of the nozzle surfaces 18*a* using the cover 100.

In the present example, the ink is accumulated in a fixed position (of the rim of the nozzle surfaces 18*a*, an edge portion of the upstream side or the downstream side in the transport direction), that is, an ink accumulation is formed in the fixed position, and since the position is covered by the cover 100, it is possible to more efficiently and effectively prevent the paper P from making contact with the ink accumulation.

In the present example, since the wiper 94 accumulates the ink at the rim portion 18*b* of the upstream side of the rim of the nozzle surfaces 18*a* in the transport direction, and the cover 100 covers the rim portion 18*b* of the upstream side of the nozzle surfaces 18*a* in the transport direction, it is possible to avoid the leading end of the paper P which proceeds from the upstream side to the downstream side in the transport direction catching on the cover 100.

In the present example, since the cover 100 also serves as a guide member which guides the paper P to the downstream side, it is possible to obtain cost reductions in the apparatus.

Modification Examples of Example (1) In the present example, a configuration is adopted in which the ink is accumulated at the rim portion 18*b* of the upstream side of the nozzle surfaces 18*a* in the transport direction, the ink accumulation 96 is allowed to form, and the ink accumulation 96 is covered by the cover 100; however, instead of this configuration, a configuration may be adopted in which the ink is accumulated at the rim portion of the downstream side of the nozzle surfaces 18*a* in the transport direction, the ink accumulation is allowed to form, and the formed ink accumulation is covered by the cover 100.

(2) In the present example, a configuration is adopted in which the ink is accumulated at the rim portion 18*b* of the upstream side of the nozzle surfaces 18*a* in the transport direction; however, instead of this configuration, a configuration may be adopted in which the wiper 94 is formed in a letter V shape in a direction intersecting the paper transport direction, the ink is accumulated at a center portion of the nozzle surfaces 18*a* in the transport direction, the ink accumulation is formed at the rim portion of the front surface side or the rear surface side of the nozzle surfaces 18*a* in the apparatus depth direction, and the cover 100 is configured to cover the rim portion of the front surface side or the rear surface side of the nozzle surfaces 18*a* in the apparatus depth direction.

(3) In the present example, a configuration is adopted in which the withdrawn position of the support section 44 is provided on the upstream side in the paper transport direction, and the withdrawn position of the cap section 72 is provided on the downstream side in the transport direction; however, instead of this configuration, a configuration may be adopted in which the withdrawn position of the support section 44 is provided on the downstream side in the paper transport direction, and the withdrawn position of the cap section 72 is provided on the upstream side in the transport direction.

(4) In the present example, the support section 44 is configured as a member which supports a medium; however, instead of this configuration, the support section 44 may be configured as a belt transport unit which transports the paper P using belt transportation in a region facing the nozzle surfaces 18*a* of the line head 18. The belt transport unit may be configured to be capable of switching between an orientation facing the nozzle surfaces 18*a* and an orientation withdrawn from the nozzle surfaces 18*a* by rocking.

(5) In the present example, the cover 100 is configured to rotate in relation to the nozzle surfaces 18*a* of the line head 18; however, the cover 100 may be configured to cover the ink accumulation of the rim portion of the nozzle surfaces 18*a* by sliding movement along the paper transport direction.

(6) In the present example, a configuration may be adopted in which the wiping is performed by the wiper 94 which is a blade-shaped member; however, instead of this configuration, a configuration may be adopted in which the wiping is performed using a cloth or another member.

(7) In the present example, the plurality of nozzle surfaces 18*a* are arranged inclined in a direction intersecting the paper transport direction; however, instead of this configuration, the nozzle surfaces 18*a* may be configured in staggered formation, and, in addition, a configuration may be adopted in which the orientation and arrangement pattern of the plurality of nozzle surfaces 18*a*, the shapes of the nozzle surfaces 18*a*, and the like are changed, as appropriate, and the nozzle surfaces 18*a* are arranged.

(8) In the present example, a configuration is adopted in which the wiping operation is performed after the flushing; however, a configuration may be adopted in which the wiping operation is performed independently.

(9) In the present example, a configuration is adopted in which the operations of the line head 18, the support section 44, and the cap section 72 are performed sequentially; however, a configuration may be adopted in which, in the switching operation of the cover 100 between the first state and the second state, at least a portion of the operations of the switching operations in the line head 18, the support section 44, and the cap section 72 are performed at the same time as long as doing so does not interfere with the support section 44 and the cap section 72.

(10) In the present example, a configuration is adopted in which the single paper detection sensor 43 is provided on each of the upstream side and the downstream side of the line head 18; however, instead of this configuration, a configuration may be adopted in which at least one or more of the paper detection sensors 43 is provided on the paper transport path 22.

(11) In the present example, the cover 100 is configured to rotate due to the engagement of the pushing section 116 and the pushing-target section 112; however, instead of this configuration, a configuration may be adopted in which the cover 100 is rotated, or caused to move by sliding, in relation to the nozzle surfaces 18*a* by driving the cover drive unit 98 using the driving force of a drive motor or the like.

(12) In the present example, the first receiving position (the sealing position) and the second receiving position (the flushing position) in the cap section 72 are set such that the first receiving position is higher than the second receiving position in the apparatus height direction; however, instead of this configuration, the first receiving position and the second receiving position may be set to the same position in the apparatus height direction.

Regarding Relationship Between Jam Processing and Cover

Hereinafter, description will be given of the operation of the cover 100 in paper jam processing in the printer 10 which is provided with a configuration that drives the cover drive unit 98 using the driving force of a drive motor or the like to cause the cover 100 to rotate or move by sliding in relation to the nozzle surfaces 18*a*.

Referring again to FIGS. 2 and 3, in the present modification example, the paper detection sensor 43 is provided on each of the upstream side and the downstream side of the line head 18 in the straight path 24. Here, the paper detection sensor 43 is configured to be capable of detecting that the leading end of the paper P has passed.

In the present modification example, in a case in which the paper detection sensor 43 of the downstream side of the line head 18 cannot detect the passage of the leading end of the paper P within a predetermined time from when the paper detection sensor 43 of the upstream side of the line head 18 detects the passage of the leading end of the paper P which is transported at a predetermined transport speed to the straight path 24, the control section 62 determines that the paper P has caused a paper jam between the paper detection sensor 43 of the upstream side and the paper detection sensor 43 of the downstream side. Note that, here, the predetermined time is the time taken for the leading end of the paper P which is transported at the predetermined transport speed to move from the paper detection sensor 43 of the upstream side to the paper detection sensor 43 of the downstream side.

In a case in which the control section 62 determines that the paper P is causing a paper jam between the paper detection sensor 43 of the upstream side and the paper detection sensor 43 of the downstream side, guidance display (not shown) regarding the paper jam processing is performed on the display panel 23 in order to remove the jammed paper P from the straight path 24.

Based on the guidance display which is displayed on the display panel 23, for example, the user can expose a portion of the paper transport path 22 by opening the opening/closing unit 118 or the unit body 120 in relation to the apparatus main body 12 to perform the paper jam processing. At this time, there is a case in which the opening/closing unit 118 is set to an open state in relation to the apparatus main body 12, and the paper P which caused the paper jam between the paper detection sensor 43 of the upstream side and the paper detection sensor 43 of the downstream side is pulled out from the upstream side in the transport direction.

In this case, the control section 62 drives the cover drive unit 98 using the driving force of the drive motor or the like, and can maintain the cover 100 in the first state. As a result, when pulling out the paper P which caused the paper jam between the paper detection sensor 43 of the upstream side and the paper detection sensor 43 of the downstream side from the upstream side in the transport direction, it is possible to more reliably prevent the paper P which is pulled out from making contact with the ink accumulation 96 in the rim portion 18*b* of the line head 18.

When pulling out the paper P which caused the paper jam between the paper detection sensor 43 of the upstream side and the paper detection sensor 43 of the downstream side, the control section 62 can cause the line head 18 to withdraw to the top side in the apparatus height direction. Accordingly, it is possible to suppress the contact made by the paper P which is pulled out, that is, the paper P in a state in which the ink is ejected thereon with the nozzle surfaces 18*a* of the line head 18, and it is possible to suppress dirtying of the nozzle surfaces 18*a*.

To summarize the above descriptions, in the present example, the printer 10 is provided with the line head 18 which includes the ink ejecting nozzles which eject the ink onto the paper P in the nozzle surfaces 18*a*, the wiper 94 which wipes the nozzle surfaces 18*a*, and the cover 100 which is positioned between the paper P and the rim portion 18*b* of the nozzle surfaces 18*a* and covers the rim portion 18*b* of the nozzle surfaces 18*a*.

The printer 10 is provided with the cap section 72 which receives the ink which is ejected from the line head 18. The cap section 72 is configured to be capable of moving between the receiving position facing the line head 18 and the withdrawn position which is withdrawn from the receiving position. The cover 100 is provided to be capable of switching between the first state in which the cover 100 covers the rim portion 18*b* of the nozzle surfaces 18*a*, and the second state in which the cover 100 is separated from the rim portion 18*b*. The receiving position of the cap section 72 is positioned on the movement track of the cover 100 between the first state and the second state, and the cover 100 assumes the second state during the operation of the cap section 72.

The cap section 72 is a cap section capable of sealing the line head 18, and the receiving position is a sealing position at which the cap section 72 seals the nozzle surfaces 18*a*. The cap section 72 is a flushing receiving section which receives the ink which is ejected during the flushing which the line head 18 carries out before the wiping is performed, and the receiving position is a position at which the ink droplets which are ejected during the flushing do not splash in the periphery of the cap section 72.

The receiving position of the cap section 72 includes a first receiving position and a second receiving position. The first receiving position is a sealing position at which the cap section 72 seals the nozzle surfaces 18*a*, and the second receiving position is a position at which the droplets which are ejected during the flushing do not splash on the periphery of the cap section 72.

The line head 18 is provided to be capable of proceeding and withdrawing in relation to the cap section 72 which is in the receiving position. According to the proceeding or withdrawing operation of the line head 18, the cover 100 switches from the first state to the second state when the line head 18 proceeds in relation to the cap section 72, and switches from the second state to the first state when the line head 18 separates from the cap section 72.

The printer 10 is provided with the support section 44 which is capable of supporting the paper P. The line head 18 is capable changing height in relation to the support section 44 according to the type of the paper P and performing the recording. When the line head 18 is lowered to a position lower than the lowest position when performing the recording, the cover 100 moves from the first state to the second state.

The printer 10 is provide with the support section 44 which is capable of switching between a facing state in which the support section 44 is capable of facing the line head 18 and supporting the paper P, and a non-facing state in which the support section 44 does not face the line head 18. The support section 44 which is in the facing state is positioned on the movement track of the cover 100 between the first state and the second state, and the cover 100 moves to the second state when the support section 44 is positioned in the non-facing state.

The printer 10 is provided with the support section 44 which faces the line head 18 and is capable of supporting the paper P, the straight path 24 which transports the paper P to the line head 18, the face-down output path 30 which outputs the paper P which is recorded on by the line head 18, and at least one of the paper detection sensors 43, each of which detects passage of the paper P over the straight path 24 and the face-down output path 30. In a case in which the paper detection sensor 43 determines that the paper P is jammed, the cover 100 maintains the first state. In a case in which the paper detection sensor 43 determines that the paper P is jammed, the line head 18 is moved in a direction in which the line head 18 separates from the support section 44.

In the printer 10, the line head 18 is provided to extend in the apparatus depth direction which is a direction intersecting the transport direction of the paper P, the wiper 94 accumulates the ink at the rim portion 18*b* of the upstream side or the rim portion of the downstream side of the rim of the nozzle surfaces 18*a* in the transport direction by moving in the apparatus depth direction to wipe the nozzle surfaces 18*a* in a state of having an inclination angle in relation to the transport direction of the paper P, and the 100 cover covers the rim portion 18*b* of the upstream side or the rim portion of the downstream side of the rim portion of the nozzle surfaces 18*a* in the transport direction at which the ink is accumulated.

In the printer 10, the wiper 94 accumulates the ink at the rim portion 18*b* of the upstream side of the rim portion of the nozzle surfaces 18*a* in the transport direction. The cover 100 covers the rim portion 18*b* of the upstream side of the nozzle surfaces 18*a* in the transport direction. The cover 100 also serves as the guide member which guides the paper P to the downstream side.

Note that, in the embodiment described above, the line head 18 which is the recording head is of a type which ejects a liquid in a fixed state without moving; however, the invention is not limited thereto, and it is possible to apply the invention to a type in which the liquid is ejected from the nozzles of the recording head while moving the recording head in a predetermined direction.

In the present embodiment, the cover 100 according to the invention is applied to an ink jet printer which is an example of the recording apparatus; however, it is possible to generally apply the cover 100 to other liquid ejecting apparatuses.

Here, the liquid ejecting apparatus is not limited to a recording apparatus such as a printer, a copier, and a facsimile in which an ink jet system recording head is used and recording is performed on a recording medium by ejecting ink from the recording head, and the liquid ejecting apparatus includes an apparatus which ejects a liquid corresponding to the use-case instead of an ink from a liquid ejecting head corresponding to the ink jet system recording head onto an ejection target medium corresponding to the recording medium and causes the liquid to be adhered to the ejection target medium.

In addition to the recording head, examples of the liquid ejecting head include a color material ejecting head which is used in the manufacture of color filters of a liquid crystal display or the like, an electrode material (conductive paste) ejecting head which is used in the formation of electrodes of an organic EL display, a field emission display (FED), or the like, a biological organic matter ejecting head which is used in the manufacture of bio-chips, and a sample ejecting head which is a precision pipette.

Note that, the invention is not limited to the example described above, may be modified in various ways within the scope of the invention described in the claims, and it goes without saying that the modifications are also included in the scope of the invention.

The entire disclosure of Japanese Patent Application No.: 2015-067234, filed Mar. 27, 2015 is expressly incorporated by reference herein.

What is claimed is:

1. A recording apparatus comprising:

a recording head with liquid ejecting nozzles which eject a liquid onto a recording medium provided in a nozzle surface;

a wiper which wipes the nozzle surface; and a cover which covers a rim of the nozzle surface, wherein a relative position of the cover and the nozzle surface is switched between a case in which the liquid is ejected from the recording head and a case in which the nozzle surface is wiped.

2. The recording apparatus according to claim 1, further comprising:

a receiving section which receives the liquid which is ejected from the recording head, wherein the receiving section is configured to be capable of moving between a receiving position at which the receiving section faces the recording head and a withdrawn position at which the receiving section is withdrawn from the receiving position, wherein the cover is provided to be capable of switching between a first state of covering the rim of the nozzle surface and a second state of being separated from the rim, wherein the receiving position of the receiving section is positioned on a movement track of the cover between the first state and the second state, and wherein the cover assumes the second state during operation of the receiving section.

3. The recording apparatus according to claim 2, wherein the receiving section is a cap section capable of sealing the recording head, and the receiving position is a sealing position at which the nozzle surface is sealed.

4. The recording apparatus according to claim 2, wherein the receiving section is a flushing receiving section which receives the liquid which is ejected during flushing which is carried out before the recording head performs the wiping, and the receiving position is a position at which the droplets which are ejected during the flushing do not splash on a periphery of the receiving section.

5. The recording apparatus according to claim 2, wherein the receiving position of the receiving section includes a first receiving position and a second receiving position, wherein the first receiving position is a sealing position at which the nozzle surface is sealed, and wherein the second receiving position is a position at which the droplets which are ejected during the flushing do not splash on a periphery of the receiving section.

6. The recording apparatus according to claim 5, wherein the recording head is provided to be capable of proceeding and withdrawing in relation to the receiving section which is in the receiving position, and wherein, according to a proceeding or withdrawing operation of the recording head, the cover switches from the first state to the second state when the recording head proceeds in relation to the receiving section, and switches from the second state to the first state when the recording head separates from the receiving section.

7. The recording apparatus according to claim 6, further comprising:

a support unit capable of supporting the recording medium, wherein the recording head is capable of changing a height in relation to the support unit according to a type of the recording medium and performing recording, and wherein the cover moves from the first state to the second state when the recording head is lowered to a position lower than a lowest position when performing the recording.

8. The recording apparatus according to claim 7, further comprising:

a support unit capable of switching between a facing state in which the support unit faces the recording head and is capable of supporting the recording medium, and a non-facing state in which the support unit does not face the recording head, wherein the support unit which is in the facing state is positioned on a movement track of the cover between the first state and the second state, and wherein the cover moves to the second state when the support unit is positioned in the non-facing state.

9. The recording apparatus according to claim 1, further comprising:

a support unit which faces the recording head and is capable of supporting the recording medium, a transport unit which transports the recording medium to the recording head, an output unit which outputs the recording medium which is recorded on by the recording head, and at least one detection unit which detects passage of the recording medium over the transport unit and the output unit, wherein, in a case in which the detection unit determines that the recording medium is jammed, the cover maintains the first state.

10. The recording apparatus according to claim 9, wherein, in a case in which the detection unit determines that the recording medium is jammed, the recording head is moved in a direction in which the recording head separates from the support unit.

11. The recording apparatus according to claim 10, wherein the recording head is provided to extend in a width direction which is a direction intersecting a transport direction of the recording medium, wherein the wiper accumulates the liquid at an edge portion of an upstream side or a downstream side of the rim of the nozzle surface in the transport direction by moving in the width direction to wipe the nozzle surface in a state of having an inclination angle in relation to the transport direction of the recording medium, and wherein the cover covers the edge portion of the upstream side or the downstream side of the rim of the nozzle surface in the transport direction at which the liquid is accumulated.

12. The recording apparatus according to claim 11, wherein the wiper accumulates the liquid at the upstream side of the rim of the nozzle surface in the transport direction, and wherein the cover covers the edge portion of the upstream side of the nozzle surface in the transport direction.

13. The recording apparatus according to claim 12, wherein the cover also serves as a guide member which guides the recording medium to the downstream side.

* * * * *